US009964870B2

(12) United States Patent
Yumita et al.

(10) Patent No.: US 9,964,870 B2
(45) Date of Patent: May 8, 2018

(54) ELECTROPHOTOGRAPHIC PHOTORECEPTOR AND IMAGE FORMING APPARATUS AND IMAGE FORMING METHOD USING THE SAME

(71) Applicant: Konica Minolta, Inc., Tokyo (JP)

(72) Inventors: Masanori Yumita, Hachioji (JP); Hirofumi Hayata, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/448,841

(22) Filed: Mar. 3, 2017

(65) Prior Publication Data

US 2017/0277050 A1 Sep. 28, 2017

(30) Foreign Application Priority Data

Mar. 25, 2016 (JP) ..... 2016-061573

(51) Int. Cl.

| | |
|---|---|
| ***G03G 5/06*** | (2006.01) |
| ***G03G 5/05*** | (2006.01) |
| ***G03G 15/00*** | (2006.01) |
| ***G03G 5/087*** | (2006.01) |

(52) U.S. Cl.

CPC ..... *G03G 5/0648* (2013.01); *G03G 5/056* (2013.01); *G03G 5/0542* (2013.01); *G03G 5/0618* (2013.01); *G03G 5/0661* (2013.01); *G03G 5/0696* (2013.01); *G03G 5/087* (2013.01); *G03G 15/75* (2013.01)

(58) Field of Classification Search

CPC .... G03G 5/0648; G03G 15/75; G03G 5/0542; G03G 5/0696; G03G 5/0661; G03G 5/056; G03G 5/087; G03G 5/0618

See application file for complete search history.

(56) References Cited

U.S. PATENT DOCUMENTS 8,771,910 B2 * 7/2014 Fujita ..... G03G 5/043 430/66
2006/0286470 A1 * 12/2006 Wu ..... G03G 5/0546 430/58.8

FOREIGN PATENT DOCUMENTS

JP 5-19520 * 5/1993
JP 2013130603 A 7/2013

OTHER PUBLICATIONS

Machine Translation of JP 5-19520, publised on May 1993 , pp. 1-6.*

* cited by examiner

*Primary Examiner* — Thorl Chea
(74) *Attorney, Agent, or Firm* — Lucas & Mercanti, LLP

(57) ABSTRACT

An electrophotographic photoreceptor includes at least a photosensitive layer and a protective layer sequentially layered on a conductive support, wherein the protective layer contains a cured product of a curable composition containing p-type semiconductor fine particles, an n-type organic semiconductor, and a polymerizable compound.

5 Claims, 2 Drawing Sheets

ELECTROPHOTOGRAPHIC PHOTORECEPTOR AND IMAGE FORMING APPARATUS AND IMAGE FORMING METHOD USING THE SAME

The entire disclosure of Japanese Patent Application No. 2016-061573 filed on Mar. 25, 2016 including description, claims, drawings, and abstract are incorporated herein by reference in its entirety.

BACKGROUND OF THE INVENTION

Field of the Invention

The present invention relates to an electrophotographic photoreceptor and an image forming apparatus and an image forming method using the same.

Description of the Related Art

In recent years, electrophotographic image forming apparatuses are required to exhibit further higher durability and image quality due to an increase in process speed (shortening of time between exposure and development), and the electrophotographic photoreceptors equipped in the image forming apparatuses are also required to be improved. As techniques to cope with such requirements, JP 2013-130603 A and JP 2015-175937 A disclose an electrophotographic photoreceptor containing p-type semiconductor fine particles in the protective layer.

However, further improvement in image performance is required so that the generation of image memory and fog when forming an image at a high process speed is suppressed although the durability is improved to some extent by the techniques described in JP 2013-130603 A and JP 2015-175937 A.

SUMMARY OF THE INVENTION

Accordingly, the present invention has been made in view of the above problems, and an object thereof is to provide an electrophotographic photoreceptor which exhibits excellent durability and suppresses the generation of image memory and fog even in the case of forming an image at a high process speed.

Intensive investigations have been carried out to achieve the above object, and as a result, the present inventors have found out that the above object can be achieved by an electrophotographic photoreceptor having the following configuration, thereby completing the present invention.

To achieve the abovementioned object, according to an aspect, an electrophotographic photoreceptor reflecting one aspect of the present invention comprises at least a photosensitive layer and a protective layer sequentially layered on a conductive support, wherein the protective layer contains a cured product of a curable composition containing p-type semiconductor fine particles, an n-type organic semiconductor, and a polymerizable compound.

2. The electrophotographic photoreceptor of Item. 1, wherein the n-type organic semiconductor preferably contains at least one kind of compound selected from the group consisting of compounds represented by the following General Formulas (1), (2a), (2b), (3a), (3b), (4), and (5):

[Chemical Formula 1]

General Formula (1)

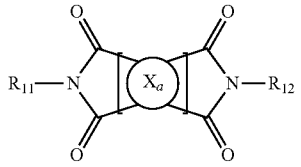

in General Formula (1), $X_a$ is a tetravalent group represented by any one of the following Chemical Formulas (1-1) to (1-5) and may have at least one substituent selected from the group consisting of a substituted or unsubstituted C1 to C8 alkyl group, a substituted or unsubstituted C1 to C8 alkoxy group, a halogen atom, a substituted or unsubstituted C6 to C18 aryl group, a cyano group, a nitro group, and a hydroxyl group, and

[Chemical Formula 2]

(1-1)

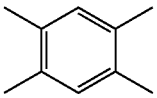

(1-2)

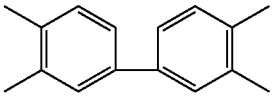

(1-3)

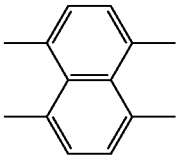

(1-4)

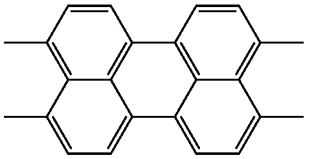

(1-5)

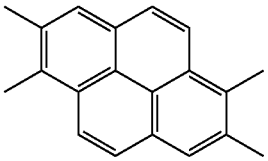

$R_{11}$ and $R_{12}$ is each independently selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, and a nitro group;

[Chemical Formula 3]

General Formula (2a)

$$R_{21}—A_1—X_b—A_2—R_{22}$$

General Formula (2b)

$$R_{21}—A_1—R_{22}$$

in General Formulas (2a) and (2b), $X_b$ is a substituted or unsubstituted C6 to C18 arylene group, $A_1$ and $A_2$ are each independently an oxadiazolylene group, and $R_{21}$ and $R_{22}$ are each independently a substituted or unsubstituted C6 to C18 aryl group, and the substituent thereof is selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, a nitro group, a carboxyl group, and a substituted or unsubstituted C1 to C8 alkoxycarbonyl group;

[Chemical Formula 4]

General Formula (3a)

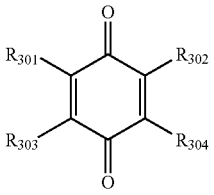

in General Formula (3a), $R_{301}$ to $R_{304}$ are each independently a group selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, a nitro group, a carboxyl group, and a substituted or unsubstituted C1 to C8 alkoxycarbonyl group and may be linked to each other to form a ring structure, and at this time, the ring structure may be either of an aromatic ring or a non-aromatic ring and may have at least one hetero atom selected from the group consisting of sulfur (S), nitrogen (N), and oxygen (O);

[Chemical Formula 5]

General Formula (3b)

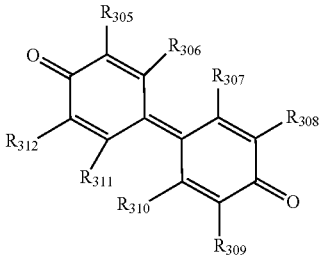

in General Formula (3b), $R_{305}$ to $R_{312}$ are each independently a group selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, a nitro group, a carboxyl group, and a substituted or unsubstituted C1 to C8 alkoxycarbonyl group and may be linked to each other to form a ring structure, and at this time, the ring structure may be either of an aromatic ring or a non-aromatic ring and may have at least one hetero atom selected from the group consisting of sulfur (S), nitrogen (N), and oxygen (O);

[Chemical Formula 6]

General Formula (4)

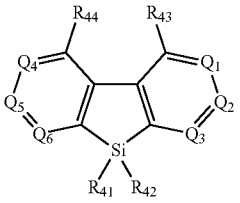

in General Formula (4), $Q_1$ to $Q_6$ are each independently a carbon atom or a nitrogen atom, $R_{41}$ and $R_{42}$ are each independently a group selected from the group consisting of a hydrogen atom, a C1 to C8 alkyl group, a substituted or unsubstituted C3 to C12 cycloalkyl group, a substituted or unsubstituted C1 to C8 alkoxy group, a substituted or unsubstituted C6 to C18 aryl group, a cyano group, a nitro group, a carboxyl group, and a substituted or unsubstituted C1 to C8 alkoxycarbonyl group and may be linked to each other to form a ring structure, and $R_{43}$ and $R_{44}$ are each independently a group selected from the group consisting of a hydrogen atom, a C1 to C8 alkyl group, a substituted or unsubstituted C3 to C12 cycloalkyl group, a substituted or unsubstituted C1 to C8 alkoxy group, a substituted or unsubstituted C6 to C18 aryl group, a cyano group, a nitro group, a substituted or unsubstituted C2 to C24 heteroaryl group, a carboxyl group, and a substituted or unsubstituted C1 to C8 alkoxycarbonyl group; and

[Chemical Formula 7]

General Formula (5)

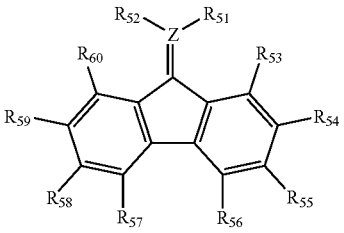

in General Formula (5),

Z is a carbon atom or a nitrogen atom, at least either of $R_{51}$ or $R_{52}$ is a nitrile group or a substituted or unsubstituted C1 to C8 alkoxycarbonyl group, and $R_{53}$ to $R_{60}$ are each independently a group selected from the group consisting of a hydrogen atom, a C1 to C8 alkyl group, a substituted or unsubstituted C6 to C18 aryl group, and a substituted or unsubstituted C1 to C8 alkoxycarbonyl group.

3. The electrophotographic photoreceptor of Item. 1 or 2, wherein the p-type semiconductor fine particles are preferably at least one kind of compound selected from the group consisting of compounds represented by the following Chemical Formulas (6) to (8):

[Chemical Formula 8]

$$M^1Cu_2O_2 \quad (6)$$

$$CuM^2O_2 \quad (7)$$

$$CuM^3O \quad (8)$$

in Chemical Formulas (6) to (8), $M^1$ is an element belonging to Group 2, $M^2$ is an element belonging to Group 13, and $M^3$ is an element belonging to Group 5.

4. The electrophotographic photoreceptor of any one of Items. 1 to 3, wherein the p-type semiconductor fine particles preferably have a reactive organic group on a surface thereof.

5. The electrophotographic photoreceptor of any one of Items. 1 to 4, wherein the polymerizable compound preferably has a (meth)acryloyl group.

To achieve the abovementioned object, according to an aspect, an image forming apparatus reflecting one aspect of the present invention comprises the electrophotographic photoreceptor of any one of Items. 1 to 5.

To achieve the abovementioned object, according to an aspect, an image forming method reflecting one aspect of the present invention comprises forming an electrophotographic image by using the image forming apparatus of Item. 6.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
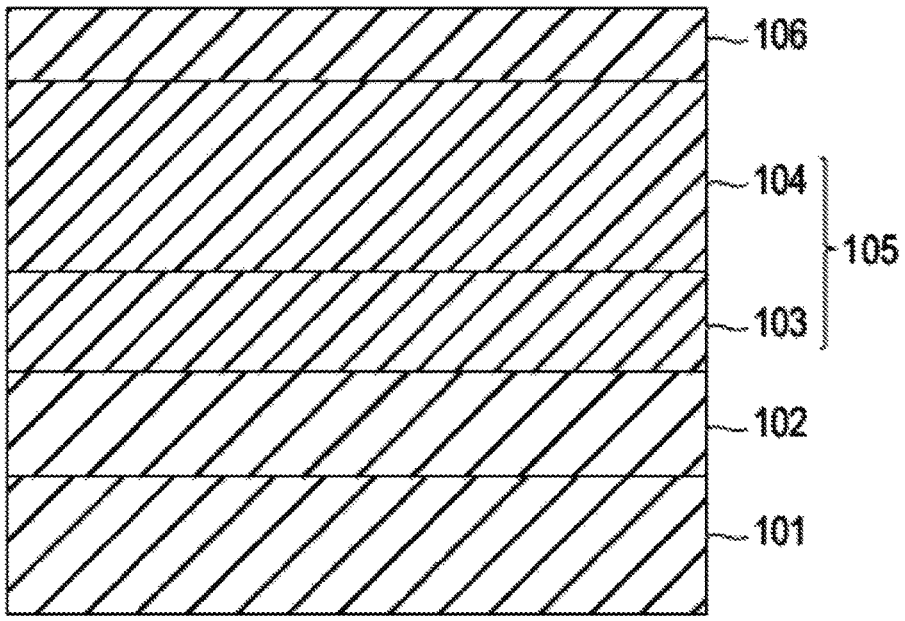
FIG. 1 is a schematic cross-sectional view of an electrophotographic photoreceptor illustrating an embodiment of the present invention.

Hereinafter, an embodiment of the present invention will be described in detail with reference to the drawings. However, the scope of the invention is not limited to the illustrated examples.

Incidentally, in the present specification, the term "X to Y" indicating the range means "X or more and Y or less". In addition, the operation and measurement of physical properties are conducted under the condition of room temperature (20 to 25° C.)/relative humidity of from 40 to 50% RH unless otherwise stated. In addition, in the present specification, the term "(meth)acryloyl group" refers to a methacryloyl group and an acryloyl group.

In addition, in the present specification, the term "substituted" refers to being substituted with a C1 to C20 alkyl group, a C2 to C20 alkenyl group, a C2 to C20 alkynyl group, a C1 to C20 alkoxy group, an alkoxycarbonyl group (—COOR, R is a C1 to C20 alkyl group), a halogen atom (F, Cl, Br, or I atom), a C6 to C30 aryl group, a C6 to C30 aryloxy group, an amino group, a C1 to C20 alkylamino group, a cyano group, a nitro group, a thiol group, a C1 to C20 alkylthio group, or a hydroxyl group unless otherwise stated.

According to an aspect of the present invention, an electrophotographic photoreceptor formed by sequentially layering at least a photosensitive layer and a protective layer on a conductive support is provided. Moreover, the protective layer of the electrophotographic photoreceptor contains a cured product of a curable composition containing p-type semiconductor fine particles, an n-type organic semiconductor, and a polymerizable compound.

According to an embodiment of the present invention, an electrophotographic photoreceptor which exhibits excellent durability and causes decreased image memory and fog even in the case of forming an image at a high process speed is provided. The mechanism by which such an effect is achieved is not completely clear, but the following mechanism is presumed.

In the case of the electrophotographic photoreceptors disclosed in JP 2013-130603 A and JP 2015-175937 A, there is a means in which the content of p-type semiconductor fine particles in the protective layer is increased as one means for coping with an increase in speed of the image forming apparatus. It is considered that this can decrease the generation of image memory, but the number of places (probability) at which the fine particles come into contact with each other increases and a local conduction path is formed when the amount of the p-type semiconductor fine particles in the protective layer increases. As a result, the surface potential in the vicinity of the conduction place locally decreases (charge is not taken) even if a charge is applied to the surface of the photoreceptor in the charging process. This causes a new problem that the attachment of toner to a non-exposed portion, so-called fog, occurs.

On the other hand, in the electrophotographic photoreceptor according an embodiment of to the present invention, an n-type organic semiconductor is added to the protective layer together with the p-type semiconductor fine particles. By this addition of an n-type organic semiconductor, both the electron transport property and the charge transport property are imparted to the protective layer, it is possible to move the residual potential after exposure to the direction of the charge transport layer in the protective layer, and a hole derived from the charge generating layer is likely to move toward the outermost surface. Hence, it is presumed that it is possible to more easily and rapidly cancel the residual potential (negative charge) than in a conventional photoreceptor. Hitherto, it has been considered how quickly moves the hole derived from the charge generating layer to the outermost surface and cancels the residual potential at the outermost surface, but in an embodiment of the present invention, variation of the surface potential is eliminated by a new system design that the residual potential of the outermost surface is moved to the interior of the photosensitive layer (the charge transport layer side), that is, the electron is moved from the upper layer to the lower layer of the photosensitive layer. It is considered that an electrophotographic photoreceptor which exhibits excellent durability and can decrease the generation of image memory and fog even in the case of forming an image at a high process speed can be obtained without increasing the amount of p-type semiconductor fine particles by this. In addition, a metal oxide (tin oxide) is used as an n-type semiconductor in the electrophotographic photoreceptor according to JP 2015-175937 A, but an organic compound is used as an n-type semiconductor in the electrophotographic photoreceptor according to an embodiment of the present invention. It is considered that the generation of fog is favorably suppressed as well as the dispersibility and film-forming property of the coating liquid are improved by this.

Incidentally, embodiments of the present invention are not limited to the above mechanism at all.

Hereinafter, an electrophotographic photoreceptor and an image forming apparatus and an image forming method using the same according to an embodiment of the present invention will be described.

<Electrophotographic Photoreceptor>

FIG. 1 is a schematic cross-sectional view of an electrophotographic photoreceptor according to an embodiment of the present invention. In the electrophotographic photoreceptor according to the present embodiment, an intermediate layer 102, a photosensitive layer 105 including a charge generating layer 103 and a charge transport layer 104, and a protective layer 106 are layered on a conductive support 101 in this order. In other words, the electrophotographic photoreceptor according to an embodiment of the present invention is formed by sequentially layering at least a photosensitive layer and a protective layer on a conductive support.

Hereinafter, the respective layers constituting the photoreceptor will be described in detail.

[Protective Layer]

(Constituent Material of Protective Layer)

The protective layer of the electrophotographic photoreceptor according to an embodiment of the present invention contains a cured product of a curable composition containing p-type semiconductor fine particles, an n-type organic semiconductor, and a polymerizable compound. Hereinafter, the respective components will be described.

<<p-type Semiconductor Fine Particles>> p-type semiconductor fine particles refer to semiconductor fine particles in which a hole is used as a carrier to transport a charge.

From the viewpoint of hole transport ability and practical utility, the p-type semiconductor fine particles contained in the protective layer of an embodiment of the present invention are preferably an oxide containing the element Cu and more preferably at least one kind of compound selected from the group consisting of compounds represented by the following Chemical Formulas (6) to (8).

[Chemical Formula 9]

$$M^1Cu_2O_2 \quad (6)$$

$$CuM^2O_2 \quad (7)$$

$$CuM^3O \quad (8)$$

In Chemical Formulas (6) to (8), $M^1$ is an element belonging to Group 2, $M^2$ is an element belonging to Group 13, and $M^3$ is an element belonging to Group 5.

Examples of the compound represented by Chemical Formula (6) may include $BeCu_2O_2$, $MgCu_2O_2$, $CaCu_2O_2$, $SrCu_2O_2$, $BaCu_2O_2$, and $RaCu_2O_2$. Among them, $SrCu_2O_2$ or $BaCu_2O_2$ is preferable.

Examples of the compound represented by Chemical Formula (7) may include $CuBO_2$, $CuAlO_2$, $CuGaO_2$, $CuInO_2$, and $CuTlO_2$. Among them, $CuAlO_2$ or $CuInO_2$ is preferable.

Examples of the compound represented by Chemical Formula (8) may include CuVO, CuTaO, and CuNbO. Among them, CuTaO or CuNbO is preferable.

In other words, the p-type semiconductor fine particles of an embodiment of the present invention are preferably selected from the group consisting of $SrCu_2O_2$, $BaCu_2O_2$, $CuAlO_2$, $CuInO_2$, CuTaO, and CuNbO.

The p-type semiconductor fine particles may be used singly or as a mixture of two or more kinds thereof.

The number average primary particle diameter of the p-type semiconductor fine particles is preferably from 1 to 1000 nm, more preferably from 10 to 500 nm, still more preferably from 10 to 100 nm, and particularly preferably from 10 to 50 nm as a value before being subjected to a surface treatment. The performance of the p-type semiconductor can be sufficiently exerted, pulverization and classification of the particles are easy, and the particles exhibit excellent practical utility when the particle diameter is 1 nm or more. Meanwhile, the particles exhibit favorable dispersibility and coatability and excellent performance as a photoreceptor when the particle diameter is 1000 nm or less.

The number average primary particle diameter of the p-type semiconductor fine particles can be calculated by analyzing a photographic image (excluding aggregated particles) obtained by taking a photograph of the p-type semiconductor fine particles enlarged by 100,000-fold by a scanning electron microscope (JSM-7500F manufactured by JEOL Ltd.) and randomly scanning 300 particles in the photograph by a scanner by an automatic image processing and analysis system ("Luzex AP" software Ver. 1.32 developed by Nireco Corporation).

Examples of the method of preparing the p-type semiconductor fine particles according to an embodiment of the present invention may include a laser ablation method, a sintering method, a crystal growth method, and a pulsed laser deposition method, but the method is not limited thereto. Examples of a specific production method thereof may include the methods described in JP 2015-141269 A, JP 2007-169089 A, JP 2002-114515 A, and Kawazoe et al., Nature, 389, 939 (1997).

The content of the p-type semiconductor fine particles in the curable composition is preferably from 10 to 500 parts by mass and more preferably from 10 to 100 parts by mass with respect to 100 parts by mass of the polymerizable compound to be described later. The hole transport ability of the protective layer is favorable when the content is 10 parts by mass or more. Meanwhile, the coatability of the coating liquid for forming a protective layer is favorable when the content is 500 parts by mass or less. This preferred content is equivalent to the preferred content of the p-type semiconductor fine particles in the protective layer.

The p-type semiconductor fine particles according to an embodiment of the present invention preferably have a reactive organic group on the surface thereof from the viewpoint of improving the wear resistance of the protective layer. It is possible to introduce a reactive organic group into the surface of the p-type semiconductor fine particles by treating the p-type semiconductor fine particles with a surface treatment agent having a reactive organic group. By such introduction, the p-type semiconductor fine particles can be involved in the curing reaction together with the polymerizable compound to be described later to form a covalent bond.

[Surface Treatment Agent]

As the surface treatment agent having a reactive organic group, a surface treatment agent exhibiting reactivity to a hydroxyl group or the like present on the surface of the p-type semiconductor fine particles is used. Examples of such a surface treatment agent may include a silane coupling agent and a titanium coupling agent. As the reactive organic group, an ionically polymerizable functional group such as an epoxy group or an oxetane group or a radically polymerizable functional group is preferable and a radically polymerizable functional group is more preferable. The radically polymerizable functional group can also react with the polymerizable compound having a polymerizable unsaturated group to form a strong protective layer. Examples of the radically polymerizable functional group may include an ethylenically unsaturated group such as a vinyl group, an acryloyl group, and a methacryloyl group, and silane coupling agents having these radically polymerizable functional groups are preferable as the surface treatment agent. Examples of the surface treatment agent as described above may include compounds represented by the following Chemical Formulas S-1 to S-36.

[Chemical Formula 10]

$CH_2{=}CHSi(CH_3)(OCH_3)_2$ S-1:

$CH_2{=}CHSi(OCH_3)_3$ S-2:

$CH_2{=}CHSiCl_3$ S-3:

$CH_2{=}CHCOO(CH_2)_2Si(CH_3)(OCH_3)_2$ S-4:

$CH_2{=}CHCOO(CH_2)_2Si(OCH_3)_3$ S-5:

$CH_2{=}CHCOO(CH_2)_2Si(OC_2H_5)(OCH_3)_2$ S-6:

$CH_2{=}CHCOO(CH_2)_3Si(OCH_3)_3$ S-7:

$CH_2{=}CHCOO(CH_2)_2Si(CH_3)Cl_2$ S-8:

$CH_2{=}CHCOO(CH_2)_2SiCl_3$ S-9:

$CH_2{=}CHCOO(CH_2)_3Si(CH_3)Cl_2$ S-10:

$CH_2{=}CHCOO(CH_2)_3SiCl_3$ S-11:

$CH_2{=}C(CH_3)COO(CH_2)_2Si(CH_3)(OCH_3)_2$ S-12:

$CH_2{=}C(CH_3)COO(CH_2)_2Si(OCH_3)_3$ S-13:

$CH_2{=}C(CH_3)COO(CH_2)_3Si(CH_3)(OCH_3)_2$ S-14:

$CH_2{=}C(CH_3)COO(CH_2)_3Si(OCH_3)_3$ S-15:

$CH_2{=}C(CH_3)COO(CH_2)_2Si(CH_3)Cl_2$ S-16:

$CH_2{=}C(CH_3)COO(CH_2)_2SiCl_3$ S-17:

$CH_2{=}C(CH_3)COO(CH_2)_3Si(CH_3)Cl_2$ S-18:

$CH_2{=}C(CH_3)COO(CH_2)_3SiCl_3$ S-19:

$CH_2{=}CHSi(C_2H_5)(OCH_3)_2$ S-20:

$CH_2{=}C(CH_3)Si(OCH_3)_3$ S-21:

$CH_2{=}C(CH_3)Si(OC_2H_5)_3$ S-22:

$CH_2{=}CHSi(OCH_3)_3$ S-23:

$CH_2{=}C(CH_3)Si(CH_3)(OCH_3)_2$ S-24:

$CH_2{=}CHSi(CH_3)Cl_2$ S-25:

$CH_2{=}CHCOOSi(OCH_3)_3$ S-26:

$CH_2{=}CHCOOSi(OC_2H_5)_3$ S-27:

$CH_2{=}C(CH_3)COOSi(OCH_3)_3$ S-28:

$CH_2{=}C(CH_3)COOSi(OC_2H_5)_3$ S-29:

$CH_2{=}C(CH_3)COO(CH_2)_3Si(OC_2H_5)_3$ S-30:

$CH_2{=}CHCOO(CH_2)_2Si(CH_3)_2(OCH_3)$ S-31:

$CH_2{=}CHCOO(CH_2)_2Si(CH_3)(OCOCH_3)_2$ S-32:

$CH_2{=}CHCOO(CH_2)_2Si(CH_3)(ONHCH_3)_2$ S-33:

$CH_2{=}CHCOO(CH_2)_2Si(CH_3)(OC_6H_5)_2$ S-34:

$CH_2{=}CHCOO(CH_2)_2Si(C_{10}H_{21})(OCH_3)_2$ S-35:

$CH_2{=}CHCOO(CH_2)_2Si(CH_2C_6H_5)(OCH_3)_2$ S-36:

Among them, S-4 to S-7 and S-12 to S-15 which are compounds having a methoxy group at one terminal and a methacryloyl group or an acryloyl group at the other terminal are preferable, and S-7 or S-15 is particularly preferable from the viewpoint of achieving the effect of an embodiment of the present invention and the viewpoint of cost and availability.

In addition, as the surface treatment agent, a silane compound having a radically polymerizable functional group may be used other than S-1 to S-36 described above. These surface treatment agents may be used singly or as a mixture of two or more kinds thereof.

[Surface Treatment Method of p-type Semiconductor Fine Particles]

The surface treatment method of p-type semiconductor fine particles is not particularly limited, but examples thereof may include a method in which a slurry containing p-type semiconductor fine particles, a surface treatment agent, and a solvent is prepared, wet pulverization and surface treatment are then conducted by using a wet media dispersion type apparatus, and the solvent is then removed from the slurry.

The wet media dispersion type apparatus of a surface treatment apparatus to be used in an embodiment of the present invention is an apparatus having a step of pulverizing and dispersing p-type semiconductor fine particles by filling beads as a medium in a container and rotating the stirring disk that is vertically attached to the rotating shaft at a high speed to crush the aggregated p-type semiconductor fine particles. As the configuration thereof, there is no problem as long as it is a type capable of sufficiently dispersing the p-type semiconductor fine particles and conducting the surface treatment at the time of conducting the surface treatment of the p-type semiconductor fine particles, and for example, various styles such as a vertical type and horizontal type and a continuous type and batch type can be employed. Specifically, a sand mill, an ultra visco mill, a pearl mill, a glen mill, a dyno mill, an agitator mill, a dynamic mill, and the like can be used. These dispersion type apparatuses conduct fine pulverization and dispersion by impulsive collapse, friction, shearing, shear stress, and the like generated by pulverization media such as balls and beads.

As the beads to be used in the wet media dispersion type apparatus, balls using glass, alumina, zircon, zirconia, steel, flintstone, or the like as a raw material can be used, but those made of zirconia or zircon are particularly preferable. In addition, as the size of the beads, those having a diameter of about from 1 to 2 mm are usually used, but those having a size of about from 0.1 to 1.0 mm are preferably used in an embodiment of the present invention.

Although various materials made of stainless steel, nylon, ceramics, and the like can be used as the disk and the inner wall of the container to be used in the wet type media dispersion type apparatus, a disk and an inner wall of the container which are made of ceramics such as zirconia or silicon carbide are particularly preferable in an embodiment of the present invention.

The amount of the surface treatment agent to be added at the time of conducting the surface treatment is preferably from 0.1 to 200 parts by mass and more preferably from 7 to 70 parts by mass with respect to 100 parts by mass of the p-type semiconductor fine particles. The p-type semiconductor fine particles exhibit excellent dispersibility and the surface layer exhibits favorable performance when the amount is 0.1 part by mass or more. Meanwhile, deterioration in electrical properties of the photoreceptor by the residual surface treatment agent is hardly caused when the amount is 200 parts by mass or less.

The amount of the solvent to be added at the time of preparing the slurry is preferably from 30 to 2,000 parts by mass with respect to 100 parts by mass of the p-type semiconductor fine particles. Examples of the solvent to be used may include toluene, xylene, methylene chloride, 1,2-dichloroethane, methyl ethyl ketone, cyclohexane, ethyl acetate, t-butyl acetate, methanol, ethanol, n-propyl alcohol, isopropyl alcohol, n-butyl alcohol, t-butyl alcohol, sec-butyl alcohol, methyl cellosolve, 4-methoxy-4-methyl-2-pentanone, ethyl cellosolve, tetrahydrofuran, 1-dioxane, 1,3-dioxolane, pyridine, and diethylamine. The solvents may be used singly or as a mixture of two or more kinds thereof.

The treatment temperature at the time of conducting the surface treatment is preferably from 20 to 100° C., and the treatment time is preferably from 1 to 24 hours.

<<n-type Organic Semiconductor>>

An n-type organic semiconductor refers to an organic semiconductor in which a free electron is used as a carrier to transport a charge.

The n-type organic semiconductor contained in the protective layer of an embodiment of the present invention is preferably at least one kind of compound selected from the group consisting of compounds represented by the following General Formulas (1), (2a), (2b), (3a), (3b), (4), and (5).

[Compound Represented by General Formula (1)]

[Chemical Formula 11]

General Formula (1)

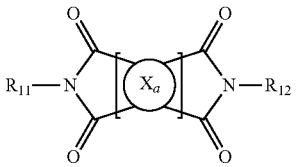

In General Formula (1), $X_a$ is a tetravalent group represented by any one of the following Chemical Formulas (1-1) to (1-5), and it is preferably a tetravalent group (a group represented by the following Chemical Formula (1-1) or (1-3)) derived from benzene or naphthalene from the viewpoint of ease of synthesis.

[Chemical Formula 12]

(1-1)

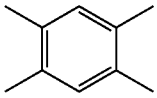

(1-2)

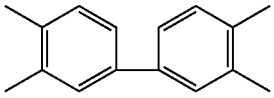

-continued (1-3)

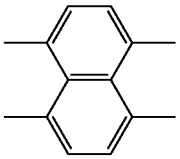

(1-4)

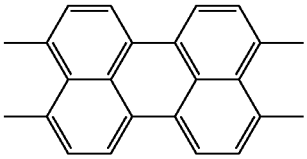

(1-5)

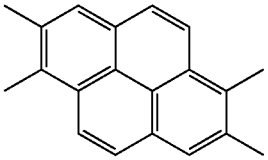

$X_a$ may not have a substituent or may have at least one substituent selected from the group consisting of a substituted or unsubstituted C1 to C8 alkyl group, a substituted or unsubstituted C1 to C8 alkoxy group, a halogen atom (F, Cl, Br or I atom), a substituted or unsubstituted C6 to C18 aryl group, a cyano group, a nitro group, and a hydroxyl group.

Examples of the unsubstituted C1 to C8 alkyl group may include a linear or branched alkyl group such as a methyl group, an ethyl group, an n-propyl group, an isopropyl group, an n-butyl group, a sec-butyl group, an isobutyl group, a tert-butyl group, an n-pentyl group, an n-hexyl group, an n-heptyl group, an n-octyl group, or a 2-ethylhexyl group.

Examples of the unsubstituted C1 to C8 alkoxy group may include a methoxy group, an ethoxy group, an n-propoxy group, an isopropoxy group, an n-butoxy group, and a sec-butoxy group.

Examples of the unsubstituted C6 to C18 aryl group may include a phenyl group, a naphthyl group, a biphenyl group, a fluorenyl group, an anthryl group, a pyrenyl group, an azulenyl group, an acenaphthylenyl group, a terphenyl group, and a phenanthryl group.

In General Formula (1), $R_{11}$ and $R_{12}$ is each independently selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom (F, Cl, Br or I atom), a substituted or unsubstituted C6 to C12 aryl group, a cyano group, and a nitro group. Incidentally, the definitions of the substituents are the same as those described above. $R_{11}$ and $R_{12}$ may be the same substituent or different substituents.

Examples of the unsubstituted C3 to C12 cycloalkyl group may include a cyclopropyl group, a cyclopentyl group, a cyclohexyl group, and an adamantyl group.

Still more preferred specific examples of $R_{11}$ and $R_{12}$ may include a 2-trifluoromethylphenyl group, a 1,2-dimethylpropyl group, a 2,6-dimethylphenyl group, a 4-pentoxycarbonylcyclohexyl group, and a 1-hexylheptyl group although $R_{11}$ and $R_{12}$ are not particularly limited.

As the compound represented by General Formula (1), either of a commercially available product or a synthetic product may be used. In the case of a synthetic product, a desired n-type organic semiconductor can be obtained by reacting a tetracarboxylic dianhydride with an amino compound in the presence or absence of a solvent (preferably an aprotic polar solvent such as dimethylformamide). Specific examples of the synthetic method may include the synthetic methods described in JP 2001-265031 A, J. Am. Chem. Soc., 120, 323 (1998), Journal of Organic Chemistry, 72, 7287-7293 (2007), and the like.

The compounds represented by General Formula (1) may be used singly or in combination of two or more kinds thereof. Incidentally, the compound represented by General Formula (1) may be further substituted with another substituent.

The compound represented by General Formula (1) is not particularly limited, but the following ETM 01 to 06 are preferable as an example thereof.

[Chemical Formula 13]

ETM01

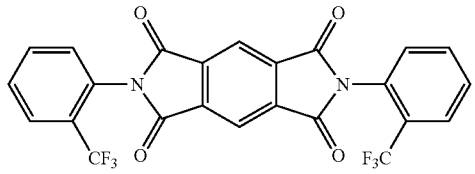

ETM02

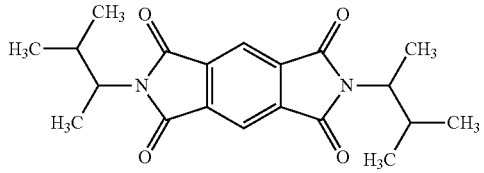

ETM03

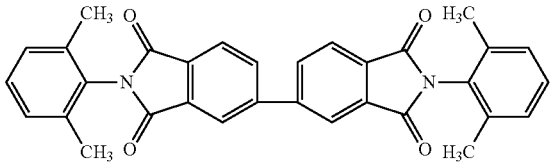

ETM04

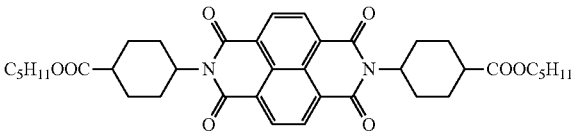

ETM05

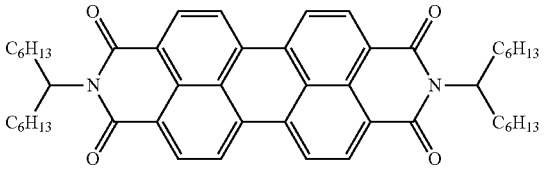

-continued

ETM06

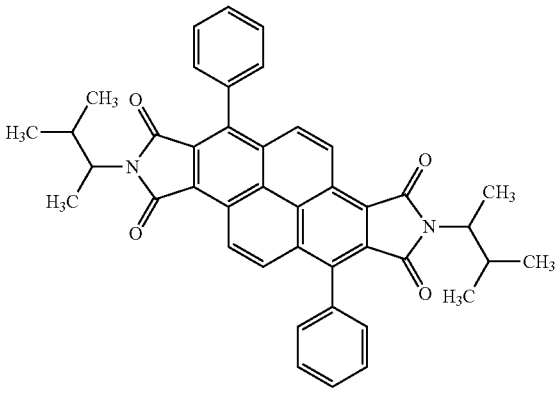

[Compound Represented by General Formula (2a) or (2b)]

[Chemical Formula 14]

$$R_{21}—A_1—X_b—A_2—R_{22} \quad \text{General Formula (2a)}$$

$$R_{21}—A_1—R_{22} \quad \text{General Formula (2b)}$$

In General Formula (2a), $X_b$ is a substituted or unsubstituted C6 to C18 arylene group, and examples thereof may include a phenylene group, a biphenylene group, a terphenylene group, and a naphthylene group. Among them, $X_b$ is preferably a biphenylene group.

In General Formula (2a), $A_1$ and $A_2$ are each independently an oxadiazolylene group. As the oxadiazolylene group, any of a 1,2,3-oxadiazolylene group, a 1,2,4-oxadiazolylene group, a 1,2,5-oxadiazolylene group, or a 1,3,4-oxadiazolylene group, but it is preferable that at least either of $A_1$ or $A_2$ is a 1,3,4-oxadiazolylene group, and it is more preferable that $A_1$ and $A_2$ are both a 1,3,4-oxadiazolylene group. $A_1$ in General Formula (2b) has the same definition as $A_1$ in General Formula (2a).

In General Formulas (2a) and (2b), $R_{21}$ and $R_{22}$ are each independently preferably a substituted or unsubstituted C6 to C18 aryl group and more preferably a substituted or unsubstituted phenyl group. In addition, the substituent which may be present in $R_{21}$ and $R_{22}$ is preferably selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, a nitro group, a carboxyl group, and a substituted or unsubstituted C1 to C8 alkoxycarbonyl group, and it is more preferably a substituted or unsubstituted C1 to C8 alkoxy group and still more preferably a substituted or unsubstituted ethoxy group.

The unsubstituted C1 to C8 alkoxycarbonyl group (—COOR) is a group in which the hydrogen atom of the carboxyl group (—COOH) is substituted with an alkyl group, and examples thereof may include a methoxycarbonyl group, an ethoxycarbonyl group, an n-propoxycarbonyl group, and an n-butoxycarbonyl group.

As the compounds represented by General Formulas (2a) and (2b), either of a commercially available product or a synthetic product may be used. The compound represented by General Formula (2a) can be obtained by reacting a dicarboxylic acid dichloride (ClOC—$X_b$—COCl) with a carboxylic acid hydrazide compound (R—CO—NH—$NH_2$) or amidoxime compound (R—C($NH_2$)═NOH) and then subjecting the carboxylic acid dihydrazine or acylamidoxime thus produced to cyclodehydration reaction, or the like in the case of a synthetic product. Specific examples of the synthetic method may include the methods described in Synthesis, 1986, #5, p. 411-413, Rekkas and J. Org. Chem., 2009, 74 (16), pp 6410-6413, Mukai, and the like.

The compounds represented by General Formula (2a) or (2b) may be used singly or in combination of two or more kinds thereof. Incidentally, the compound represented by General Formula (2a) or (2b) may be further substituted with another substituent.

The compound represented by General Formula (2a) is not particularly limited, but the following ETM 201 is preferable as an example thereof.

[Chemical Formula 15]

ETM201

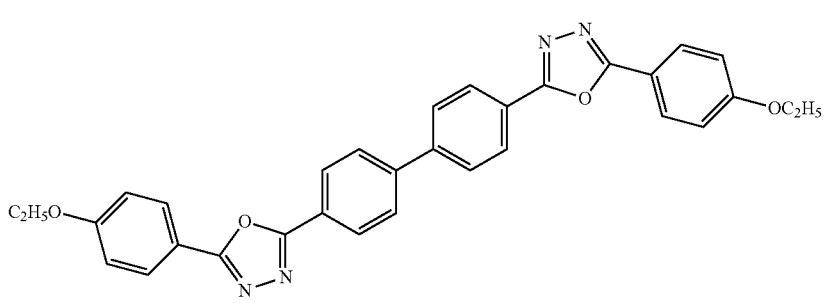

The compound represented by General Formula (2b) is not particularly limited, but 2,5-diphenyl-1,3,4-oxadiazole that is substituted with a phenyl group or not substituted is preferable as an example thereof, and specific examples thereof may include the following ETM 202 and ETM 203.

[Chemical Formula 16]

ETM202

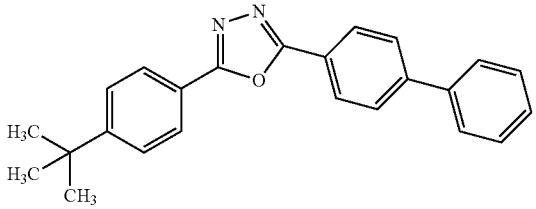

ETM203

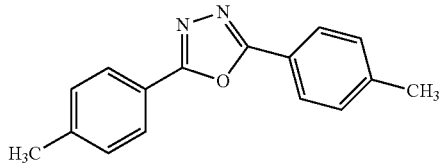

[Compound Represented by General Formula (3a)]

[Chemical Formula 17]

General Formula (3a)

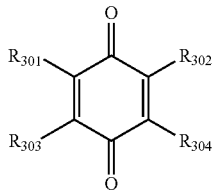

In General Formula (3a), $R_{301}$ to $R_{304}$ are each independently a group selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, a nitro group, a carboxyl group, and a substituted or unsubstituted C1 to C8 alkoxycarbonyl group, and they may be linked to each other to forma ring structure. At this time, the ring structure may be either of an aromatic ring or a non-aromatic ring (preferably an aromatic ring), and it may have at least one hetero atom selected from the group consisting of sulfur (S), nitrogen (N), and oxygen (O).

As the compound represented by General Formula (3a), either a commercially available product or a synthetic product may be used. In addition, the compounds represented by General Formula (3a) may be used singly or in combination of two or more kinds thereof.

The compound represented by General Formula (3a) is not particularly limited, but examples thereof may include 2,5-di-tert-butyl-p-quinone, 2,6-di-tert-butyl-p-quinone, 2,3,5,6-tetra-tert-butyl-p-quinone, naphthoquinone, anthraquinone, and the following ETM 301 to ETM 303.

[Chemical Formula 18]

ETM301

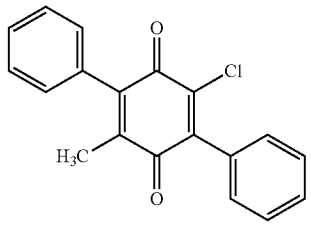

-continued

ETM302

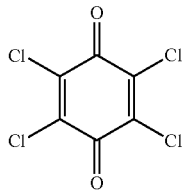

ETM303

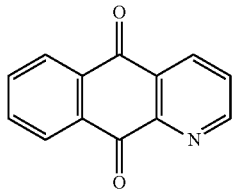

[Compound Represented by General Formula (3b)]

[Chemical Formula 19]

General Formula (3b)

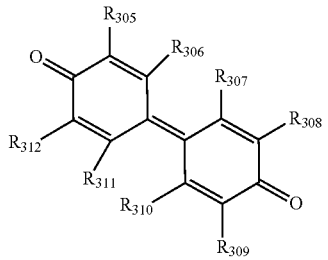

In General Formula (3b), $R_{305}$ to $R_{312}$ are each independently a group selected from the group consisting of a hydrogen atom, a substituted or unsubstituted C1 to C8 alkyl group, a substituted or unsubstituted C3 to C12 cycloalkyl group, a substituted or unsubstituted C1 to C8 alkoxy group, a halogen atom, a substituted or unsubstituted C6 to C18 aryl group, a cyano group, a nitro group, a carboxyl group, and a substituted or unsubstituted C1 to C8 alkoxycarbonyl group, and they may be linked to each other to form a ring structure. At this time, the ring structure may be either of an aromatic ring or a non-aromatic ring (preferably an aromatic ring), and it may have at least one hetero atom selected from the group consisting of sulfur (S), nitrogen (N), and oxygen (O). Among them, $R_{305}$ to $R_{312}$ are each independently preferably a hydrogen atom or a substituted or unsubstituted C1 to C4 alkyl group and preferably a hydrogen atom or a tert-butyl group. Furthermore, it is preferable that preferably one, more preferably two, still more preferably three, and particularly preferably four of $R_{305}$, $R_{308}$, $R_{309}$, and $R_{312}$ are substituted with a substituent other than a hydrogen atom.

The compound represented by General Formula (3b) is not particularly limited, but examples thereof may include 3,3',5,5'-tetra-tert-butyl-4,4'-diphenoquinone (ETM 311), 3,3',5,5'-tetramethyl-4,4'-diphenoquinone, 3,3',5,5'-tetraethyl-4,4'-diphenoquinone, 3,3',5,5'-tetra-n-butyl-4,4'-diphenoquinone, 3,3'-di-tert-butyl-5,5'-dimethyl-4,4'-diphenoquinone (ETM 312), bianthrone (ETM 313), and the following ETM 314, and 3,3',5,5'-tetra-tert-butyl-4,4'-diphenoquinone (ETM 311) is preferable.

[Chemical Formula 20]

ETM314

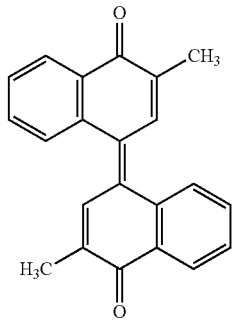

As the compound represented by General Formula (3b), either of a commercially available product or a synthetic product may be used. A commercially available product can be purchased from Sigma-Aldrich Co., LLC., Tokyo Chemical Industry Co., Ltd., and the like.

The compounds represented by General Formula (3b) may be used singly or in combination of two or more kinds thereof. Incidentally, the compound represented by General Formula (3b) may be further substituted with another substituent.

[Compound Represented by General Formula (4)]

[Chemical Formula 21]

General Formula (4)

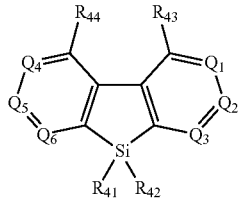

In General Formula (4), $Q_1$ to $Q_6$ are each independently a carbon atom or a nitrogen atom, and preferably at least one of $Q_1$ to $Q_6$ is a nitrogen atom, more preferably $Q_1$ or $Q_4$ is a nitrogen atom, and still more preferably $Q_1$ is a nitrogen atom.

In addition, in General Formula (4), $R_{41}$ and $R_{42}$ are each independently a group selected from the group consisting of a hydrogen atom, a C1 to C8 alkyl group, a substituted or unsubstituted C3 to C12 cycloalkyl group, a substituted or unsubstituted C1 to C8 alkoxy group, a substituted or unsubstituted C6 to C18 aryl group, a cyano group, a nitro group, a carboxyl group, and a substituted or unsubstituted C1 to C8 alkoxycarbonyl group, and $R_{41}$ and $R_{42}$ may be linked to each other to form a ring structure. Among them, at least either of $R_{41}$ or $R_{42}$ is preferably a substituted or unsubstituted C6 to C18 aryl group and more preferably a substituted or unsubstituted phenyl group.

In General Formula (4), $R_{43}$ and $R_{44}$ are each independently a group selected from the group consisting of a hydrogen atom, a C1 to C8 alkyl group, a substituted or unsubstituted C3 to C12 cycloalkyl group, a substituted or unsubstituted C1 to C8 alkoxy group, a substituted or unsubstituted C6 to C18 aryl group, a cyano group, a nitro group, a substituted or unsubstituted C2 to C24 heteroaryl group, a carboxyl group, and a substituted or unsubstituted C1 to C8 alkoxycarbonyl group.

Examples of the unsubstituted C2 to C24 heteroaryl group may include a furyl group, a thienyl group, a pyridyl group, a pyridazinyl group, a pyrimidinyl group, a pyrazinyl group, a triazinyl group, an imidazolyl group, a pyrazolyl group, a thiazolyl group, a quinazolinyl group, a carbazolyl group, a carbolinyl group, an azacarbazolyl group, a benzofuryl group, a dibenzofuryl group, an azadibenzofuryl group, a benzothienyl group, an indolyl group, a dibenzothienyl group, a benzimidazolyl group, an oxazolyl group, a benzoxazolyl group, a quinoxalinyl group, an isoxazolyl group, an isothiazonyl group, an indolocarbazolyl group, a hexaazatriphenylenyl group, a benzodifuranyl group, a benzodithienyl group, a phosphoryl group, a silyl group, a boryl group, and a bipyridyl group.

Among them, at least either of $R_{43}$ or $R_{44}$ is preferably a substituted or unsubstituted C2 to C24 heteroaryl group, more preferably a substituted or unsubstituted C2 to C24 nitrogen-containing heteroaryl group, still more preferably a substituted or unsubstituted C5 to C12 nitrogen-containing heteroaryl group, and particularly preferably a carbazolyl group.

As the compound represented by General Formula (4), either of a commercially available product or a synthetic product may be used. Specific examples of the synthetic method thereof may include the synthetic methods described in Science, 1998, 282, 913 to 915, J. Am. Org. Chem., 2002, VOL. 67, 9392 to 9396, J. Org. Chem., 2006, VOL. 71, 7826 to 7834, J. Am. Chem. Soc., VOL. 124, No. 1,2002, 49 to 57, WO 2006/002731 A, J. Am. C. S., [Section] B, Physical Organic 1996, 733-735, Chem. Lett., 1982, 1195 to 1198, and the like.

The compounds represented by General Formula (4) may be used singly or in combination of two or more kinds thereof. Incidentally, the compound represented by General Formula (4) may be further substituted with another substituent.

The compound represented by General Formula (4) is not particularly limited, but the following ETM 401 is preferable as an example thereof.

[Chemical Formula 22]

ETM401

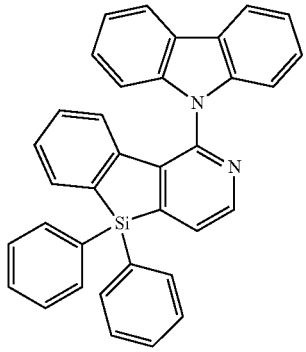

[Compound Represented by General Formula (5)]

[Chemical Formula 23]

General Formula (5)

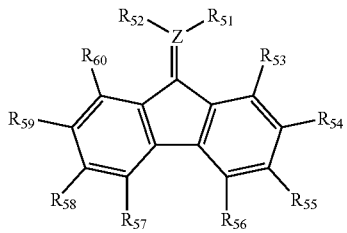

In General Formula (5), Z is a carbon atom or a nitrogen atom and preferably a carbon atom.

In addition, in General Formula (5), at least either of $R_{51}$ or $R_{52}$ is a nitrile group or a substituted or unsubstituted C1 to C8 alkoxycarbonyl group and preferably a nitrile group, and more preferably $R_{51}$ and $R_{52}$ are both a nitrile group.

In addition, in General Formula (5), $R_{53}$ to $R_{60}$ are each independently a group selected from the group consisting of a hydrogen atom, a C1 to C8 alkyl group, a substituted or unsubstituted C6 to C18 aryl group, a carboxyl group, and a substituted or unsubstituted C1 to C8 alkoxycarbonyl group.

Preferably one, more preferably two, still more preferably three, and particularly preferably four, all of $R_{57}$ to $R_{60}$ are a hydrogen atom.

At least one of $R_{53}$ to $R_{56}$ is preferably a substituted or unsubstituted C6 to C18 aryl group and preferably a substituted or unsubstituted phenyl group. In addition, the rest groups of $R_{53}$ to $R_{56}$ are preferably a substituted or unsubstituted C1 to C8 alkoxycarbonyl group, more preferably a substituted or unsubstituted C1 to C4 alkoxycarbonyl group, and still more preferably a substituted or unsubstituted methoxycarbonyl group (—$COOCH_3$).

As the compound represented by General Formula (5), either of a commercially available product or a synthetic product may be used. In addition, the compounds represented by General Formula (5) may be used singly or in combination of two or more kinds thereof. Incidentally, the compound represented by General Formula (5) may be further substituted.

The compound represented by General Formula (5) is not particularly limited, but the following ETM 501 is preferable as an example thereof.

[Chemical Formula 24]

ETM501

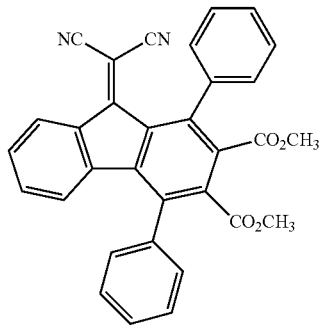

The compounds represented by (1), (2a), (2b), (3a), (3b), (4), and (5) described above may be used singly or in combination of two or more kinds thereof.

The content of the n-type organic semiconductor in the curable composition is preferably from 0.1 to 50 parts by mass, more preferably from 0.5 to 20 parts by mass, still more preferably from 1.0 to 15 parts by mass, and particularly preferably from 5.0 to 10 parts by mass with respect to 100 parts by mass of the polymerizable compound to be described later. The function as an n-type organic semiconductor is favorably exerted when the content is 0.1 part by mass or more. Meanwhile, the protective layer exhibits excellent durability and an increase in lifespan of the photoreceptor can be achieved when the content is 50 parts by mass or less. This preferred content is equivalent to the preferred content of the n-type organic semiconductor in the protective layer.

In addition, the proportion of the p-type semiconductor fine particles to the n-type organic semiconductor contained in the curable composition is preferably from 1:1 to 50:1, more preferably from 5:1 to 25:1, and still more preferably from 10:1 to 20:1. It is possible to exhibit excellent image memory resistance and to favorably suppress the generation of fog as the proportion is in the above range. This preferred contained proportion is equivalent to the preferred contained proportion in the protective layer.

<<Polymerizable Compound>>

As the polymerizable compound usable in the protective layer according to an embodiment of the present invention, a monomer which is polymerized (cured) by being irradiated with active energy rays such as ultraviolet rays or electron rays to be a resin that is generally used as a binder resin of a photoreceptor such as polystyrene or poly(meth)acrylate is suitable. In particular, a styrene-based monomer, an acrylic monomer, a methacrylic monomer, a vinyltoluene-based monomer, a vinyl acetate-based monomer, and an N-vinylpyrrolidone-based monomer are preferable.

Among them, a radically polymerizable monomer having a polymerizable unsaturated group such as an acryloyl group ($CH_2{=}CHCO{-}$) or a methacryloyl group ($CH_2{=}CCH_3CO{-}$) or an oligomer thereof is preferable since it can be cured by a small amount of light or in a short time. In other words, the polymerizable compound according to an embodiment of the present invention preferably has a (meth)acryloyl group.

In an embodiment of the present invention, the polymerizable compounds described above may be used singly or as a mixture of two or more kinds thereof. In addition, these polymerizable compounds may be used as a monomer or an oligomer.

Examples of these polymerizable compounds may include the following compounds, but the polymerizable compounds are not limited thereto. In addition, the polymerizable compounds to be exemplified below are known and available as a commercial product.

[Chemical Formula 25]

M1

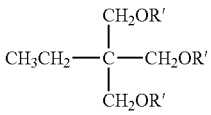

M2

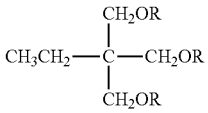

-continued

M3

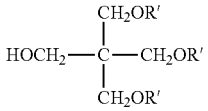

M4

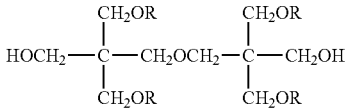

M5

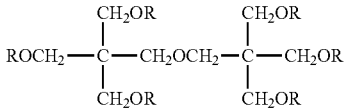

M6

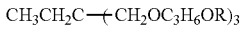

M7

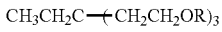

M8

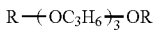

M9

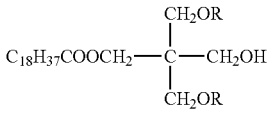

M10

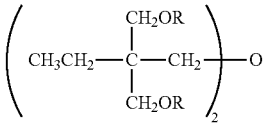

M11

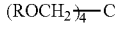

M12

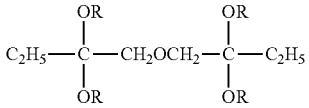

M13

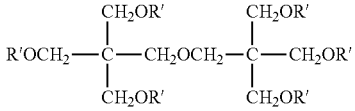

M14

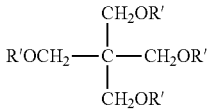

In the above formulas, R represents an acryloyl group and R' represents a methacryloyl group (see the following Chemical Formulas below), respectively.

[Chemical Formula 26]

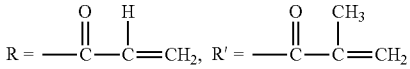

Among the above compounds, examples of the polymerizable compound to be suitably used in an embodiment of the present invention may include the exemplified compound M1, the exemplified compound M2, and the exemplified compound M3.

As the polymerizable compound, it is preferable to use a compound having three or more polymerizable unsaturated groups. In addition, two or more kinds of compounds may be used concurrently as the polymerizable compound, but in this case as well, it is preferable to use a compound having three or more polymerizable unsaturated groups at 50% by mass or more with respect to 100% by mass of the polymerizable compound. In addition, the equivalent of polymerizable unsaturated group, namely, "the molecular weight of a compound having a polymerizable unsaturated group/the number of unsaturated groups" is preferably 1000 or less and more preferably 500 or less. This increases the cross-linking density of the protective layer and improves the wear resistance.

[Polymerization Initiator]

In an embodiment of the present invention, a protective layer is formed by curing the curable composition, but a method in which the curable composition is reacted through electron beam cleavage, a method in which a radical polymerization initiator is added and the curable composition is reacted by light or heat, and the like are used at the time of curing the curable composition. As the polymerization initiator, either of a photopolymerization initiator or a thermal polymerization initiator can be used, and both of a photopolymerization initiator and a thermal polymerization initiator can be used concurrently.

Examples of the thermal polymerization initiator may include an azo compound such as 2,2'-azobisisobutyronitrile, 2,2'-azobis(2,4-dimethylazobisvaleronitrile), or 2,2'-azobis(2-methylbutyronitrile); and a peroxide such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, or lauroyl peroxide.

Examples of the photopolymerization initiator may include an acetophenone-based or ketal-based photopolymerization initiator such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 ("Irgacure (registered trademark) 369": manufactured by BASF SE), 2-hydroxy-2-methyl-1-phenylpropane-1-one, 2-methyl-2-morpholino (4-methylthiophenyl)propane-1-one, 1-phenyl-1,2-propanedione-2-(o-ethoxycarbonyl)oxime; a benzoin ether-based photopolymerization initiator such as benzoin, benzoin methyl ether, benzoin ethyl ether, benzoin isobutyl ether, or benzoin isopropyl ether; a benzophenone-based photopolymerization initiator such as benzophenone, 4-hydroxybenzophenone, methyl o-benzoylbenzoate, 2-benzoylnaphthalene, 4-benzoylbiphenyl, 4-benzoylphenyl ether, acrylated benzophenone, or 1,4-benzoylbenzene; and a thioxanthone-based photopolymerization initiator such as 2-isopropylthioxanthone, 2-chlorothioxanthone, 2,4-dimethylthioxanthone, 2,4-diethylthioxanthone, or 2,4-dichlorothioxanthone.

Examples of other photopolymerization initiators may include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide ("Irgacure (registered trademark) 819": manufactured by BASF SE), bis(2,4-dimethoxybenzoyl)-2,4,4-trimethylpentylphosphine oxide, methylphenylglyoxy ester, 9,10-phenanthrene, an acridine-based compound, a triazine-based compound, and an imidazole-based compound. In addition, a photopolymerization accelerator having a photopolymerization accelerating effect can be used singly or concurrently with the photopolymerization initiator described above. Examples of the photopolymerization accelerator may include triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone.

As the radical polymerization initiator, a photopolymerization initiator is preferable, and among them, an alkylphenone-based compound or a phosphine oxide-based compound is preferable. In particular, a compound having an α-aminoalkylphenone structure or an acylphosphine oxide structure is preferable.

These polymerization initiators may be used singly or as a mixture of two or more kinds thereof. The content of the polymerization initiator in the curable composition is preferably from 0.5 to 30 parts by mass, more preferably from 2 to 20 parts by mass, and still more preferably from 5 to 15 parts by mass with respect to 100 parts by mass of the polymerizable compound.

<<Other Additives>>

In addition to the components described above, additives such as n-type semiconductor fine particles, lubricant particles, a leveling agent (for example, silicone oil), and an antioxidant may be contained in the protective layer according to an embodiment of the present invention. The component may be added to the curable composition according to an embodiment of the present invention. In other words, the cured product according to an embodiment of the present invention may contain the component and/or a reactant of the component.

Examples of the n-type semiconductor fine particles may include $SnO_2$, $TiO_2$, and $Al_2O_3$. As the n-type semiconductor fine particles, those prepared by a known method such as a vapor phase method, a chlorine method, a sulfuric acid method, a plasma method, or an electrolytic method can be used. It is preferable that the n-type semiconductor fine particles have a reactive organic group on the surface thereof by being subjected to a surface treatment in the same manner as the p-type semiconductor fine particles. The number average primary particle diameter of the n-type semiconductor fine particles is preferably from 1 to 1000 nm, more preferably from 10 to 500 nm, still more preferably from 10 to 100 nm, and particularly preferably from 10 to 50 nm as a value before being subjected to a surface treatment. Incidentally, the method of measuring the number average primary particle diameter is the same as that of the p-type semiconductor fine particles.

As the lubricant particles, fluorine atom-containing resin particles may be used. As the fluorine atom-containing resin particles, at least one selected from a tetrafluoroethylene resin, a trifluorochloroethylene resin, a hexafluorochloroethylene propylene resin, a vinyl fluoride resin, a vinylidene fluoride resin, a difluorodichloroethylene resin, or any copolymer thereof is preferable, and a tetrafluoroethylene resin and a vinylidene fluoride resin are particularly preferable.

(Production Method of Protective Layer)

The protective layer according to an embodiment of the present invention can be formed by preparing a curable composition (coating liquid for forming a protective layer) in which p-type semiconductor fine particles, an n-type organic semiconductor, a polymerizable compound, and, if necessary, additives (a polymerization initiator, inorganic fine particles other than the p-type semiconductor fine particles, lubricant particles, and the like) are mixed in a solvent, coating the curable composition on a photosensitive layer to be described later, and then drying and curing the curable composition.

In the course of coating, drying, and curing, the reaction between the polymerizable compounds and the reaction between the polymerizable compound and the reactive organic group of the p-type semiconductor fine particles or the reaction between the p-type semiconductor fine particles having a reactive organic group in a case in which the p-type semiconductor fine particles have a reactive organic group proceed, whereby the protective layer is formed.

As the solvent to be used in the curable composition (coating liquid for forming a protective layer), any solvent can be used as long as it can dissolve or disperse the p-type semiconductor fine particles, the n-type organic semiconductor, and the polymerizable compound, and, if necessary, the additives described above. Specific examples of the solvent may include methanol, ethanol, propanol, isopropanol, 1-butanol, 2-butanol, tert-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, and diethylamine, but the solvent is not limited thereto. These solvents may be used singly or in combination of two or more kinds thereof.

The content of the solvent in the curable composition (coating liquid for forming a protective layer) is preferably from 10 to 90% by mass and more preferably from 30 to 80% by mass with respect to the entire coating liquid.

The method of producing the curable composition (coating liquid for forming a protective layer) is also not particularly limited, and the p-type semiconductor fine particles, the n-type organic semiconductor, the polymerizable compound, and, if necessary, the additives described above are added to a solvent, stirred and mixed until to be dissolved or dispersed. In addition, the amount of the solvent is also not particularly limited and may be appropriately adjusted so that the curable composition (coating liquid for forming a protective layer) has a viscosity suitable for the coating operation.

The coating method is not particularly limited, and it is possible to use a known method such as a dip coating method, a spray coating method, a spinner coating method, a bead coating method, a blade coating method, a beam coating method, a slide hopper method, or a circular slide hopper method.

The coating liquid after being coated is subjected to natural drying or heat drying to be formed into a coating film, and the coating film is then cured by being irradiated with active energy rays, whereby a cured product of a composition containing a polymerizable compound as a monomer component and surface-treated inorganic fine particles is produced. As the active energy rays, ultraviolet rays and electron rays are more preferable and ultraviolet rays are still more preferable.

As the ultraviolet light source, any light source which generates ultraviolet rays can be used without being limited. For example, a low pressure mercury lamp, a medium pressure mercury lamp, a high pressure mercury lamp, an ultra high pressure mercury lamp, a carbon arc lamp, a metal halide lamp, a xenon lamp, and a flash (pulse) xenon lamp can be used. The radiation conditions vary depending on the lamp, but the radiation intensity of light is preferably from 1000 to 5000 mW/cm$^2$ and more preferably from 3000 to 4000 mW/cm$^2$. The radiation intensity of light on the coating film is preferably from 500 to 3000 mW/cm$^2$ and more preferably 1000 to 2000 mW/cm$^2$. In addition, the curing process of the coating film is carried out preferably in an inert gas atmosphere more preferably in a nitrogen atmosphere.

The electron beam radiation apparatus to be used as the electron beam source is not particularly limited, and in general, a curtain beam type apparatus which is relatively inexpensive and provides a high output as an electron beam accelerator for electron beam radiation is suitably used. The accelerating voltage at the time of electron beam radiation is preferably from 100 to 300 kV. The absorbed radiation dose is preferably from 0.5 to 10 Mrad.

The radiation time of active energy rays for obtaining the required radiation dose is preferably from 0.1 second to 10 minutes and more preferably from 0.1 second to 5 minutes from the viewpoint of work efficiency.

In the course of forming the protective layer, the coating film can be subjected to drying before and after being irradiated with the active energy rays and while being irradiated with the active energy rays, and the timing to conduct drying can be appropriately selected in combination of these.

The drying conditions can be appropriately selected depending on the kind of the solvent, the film thickness, and the like. The drying temperature is preferably from 20 to 180° C., more preferably from 20 to 100° C., and still more preferably from 20 to 50° C. The drying time is preferably from 1 to 200 minutes, more preferably from 5 to 100 minutes, and still more preferably from 10 to 30 minutes.

The dry film thickness of the protective layer is preferably from 0.1 to 15 μm, more preferably from 1.0 to 10 μm, and particularly preferably from 2.0 to 5.0 μm. The film thickness unevenness of the protective layer is minor and the sharpness of the image to be formed is favorable in a case in which the film thickness of the protective layer is 15 μm or less. Meanwhile, it is possible to improve the lifespan and wear resistance of the photoreceptor in a case in which the film thickness of the protective layer is 0.1 μm or more.

[Conductive Support]

The conductive support to be used in an embodiment of the present invention may be any one as long as it exhibits conductivity, and examples thereof may include those obtained by molding metals such as aluminum, copper, chromium, nickel, zinc, and stainless steel into a drum or sheet shape, those obtained by layering a metal foil such as an aluminum foil or a copper foil on a plastic film, those obtained by depositing aluminum, indium oxide, tin oxide, or the like on a plastic film, and a metal, a plastic film, paper, and the like having a conductive layer formed by coating a conductive material thereon singly or together with a binder resin.

[Photosensitive Layer]

The photosensitive layer according to an embodiment of the present invention may have a single layer structure in which the charge generating function and a charge transporting function are imparted to one layer but a multilayer structure in which these functions are separated into a charge generating layer and a charge transport layer is preferable. By employing such a structure, it is possible to suppress an increase in residual potential due to repeated use. The charge transport layer is layered on the charge generating layer in the case of a negatively chargeable photoreceptor. The charge generating layer is layered on the charge transport layer in the case of a positively chargeable photoreceptor.

Hereinafter, the charge generating layer and the charge transport layer will be described, respectively.

(Charge Generating Layer)

The charge generating layer to be used in the photoreceptor of an embodiment of the present invention preferably contains a charge generating material and a binder resin, and it is preferably formed by dispersing a charge generating material in a binder resin solution and coating and drying the dispersion.

Examples of the charge generating material may include an azo pigment such as Sudan Red and Diane Blue, a quinone pigment such as pyrenequinone or anthanthrone, a quinocyanine pigment, a perylene pigment, an indigo pigment such as indigo or thioindigo, a polycyclic quinone pigment such as pyranthrone or diphthaloyl pyrene, and a phthalocyanine pigment, but the charge generating material is not limited thereto. A polycyclic quinone pigment and a titanyl phthalocyanine pigment are preferable. These charge generating materials may be used singly or in the form of being dispersed in a known binder resin.

As the binder resin for charge generating layer, a known resin can be used, and examples thereof may include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymer resin containing two or more of these resins (for example, a vinyl chloride-vinyl acetate copolymer resin and a vinyl chloride-vinyl acetate-anhydrous maleic acid copolymer resin), and a polyvinyl carbazole resin, but the binder resin for charge generating layer is not limited thereto. A polyvinyl butyral resin is preferable.

The charge generating layer is preferably formed by dispersing a charge generating material in a solution prepared by dissolving a binder resin in a solvent by using a disperser to prepare a coating liquid, coating the coating liquid in a predetermined film thickness by using a coater, and drying the coating film. As the coating method, the same method as in the protective layer described above can be used.

Examples of the solvent for dissolving and coating the binder resin to be used in the charge generating layer may include toluene, xylene, methylene chloride, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1-dioxane, 1,3-dioxolane, cyclohexanone, pyridine, and diethylamine, but the solvent is not limited thereto. These solvents may be used singly or as a mixture of two or more kinds thereof.

As a dispersing unit of the charge generating material, an ultrasonic dispersing machine, a ball mill, a sand mill, a homomixer, and the like can be used, but the dispersing unit is not limited thereto.

The mixed proportion of the charge generating material to the binder resin is preferably from 1 to 600 parts by mass and more preferably from 50 to 500 parts by mass with respect to 100 parts by mass of the binder resin.

The dry film thickness of the charge generating layer varies depending on the properties of the charge generating material, the properties of the binder resin, the mixed proportion, and the like, but it is preferably from 0.01 to 5 μm and more preferably from 0.05 to 3 μm. Incidentally, it is possible to prevent the generation of image defects by filtering off foreign matters and aggregates from the coating liquid for charge generating layer before being coated. Incidentally, the charge generating layer can also be formed through vacuum deposition of the pigment described above.

(Charge Transport Layer)

The charge transport layer to be used in the photoreceptor of an embodiment of the present invention preferably contains a charge transport material and a binder resin, and it is preferably formed by dissolving a charge transport material in a binder resin solution and coating and drying the dispersion.

Examples of the charge transport material may include a triphenylamine derivative, a hydrazone compound, a styryl compound, a benzidine compound, and a butadiene compound, as a material which transports a charge (a hole).

As the binder resin for charge transport layer, a known resin can be used, and examples thereof may include a polycarbonate resin, a polyacrylate resin, a polyester resin, a polystyrene resin, a styrene-acrylonitrile copolymer resin, a polymethacrylic ester resin, and a styrene-methacrylic ester copolymer resin, but a polycarbonate resin is preferable. These binder resins may be used singly or as a mixture of two or more kinds thereof. Furthermore, bisphenol A (BPA), bisphenol Z (BPZ), dimethyl BPA, a BPA-dimethyl BPA copolymer, and the like are preferable from the viewpoint of crack resistance, wear resistance, and charging property.

The charge transport layer is preferably formed by dissolving a binder resin and a charge transport material in a solvent to prepare a coating liquid, coating the coating liquid in a predetermined film thickness by using a coater, and drying the coating film. As the coating method, the same method as in the protective layer described above can be used.

Examples of the solvent for dissolving the binder resin and the charge transport material may include toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine, but the solvent is not limited thereto. These solvents may be used singly or as a mixture of two or more kinds thereof.

The mixed proportion of the charge transport material to the binder resin is preferably from 10 to 500 parts by mass and more preferably from 20 to 250 parts by mass with respect to 100 parts by mass of the binder resin.

The dry film thickness of the charge transport layer varies depending on the properties of the charge transport material, the properties of the binder resin, the mixed proportion, and the like, but it is preferably from 5 to 40 μm and more preferably from 10 to 30 μm.

An antioxidant, an electron conducting agent, a stabilizer, silicone oil, and the like may be added to the charge transport layer. Examples of the antioxidant may include the compounds described in, for example, JP 2000-305291 A. Examples of the electron conducting agent may include the compounds described in, for example, JP 50-137543 A and JP 58-76483 A.

[Other Layers]

In an embodiment of the present invention, a layer other than the photosensitive layer and the protective layer may be provided on the conductive support. In particular, it is preferable to provide an intermediate layer having a barrier function and an adhesive function between the conductive support and the photosensitive layer from the viewpoint of failure prevention or the like.

The intermediate layer can be formed by the same coating method as in the protective layer described above such as a dip coating method and a drying method after a coating liquid is prepared by dissolving a binder resin such as casein, polyvinyl alcohol, nitrocellulose, an ethylene-acrylic acid copolymer, a polyamide resin, a polyurethane resin, or gelatin in a known solvent. Among them, an alcohol-soluble polyamide resin is preferable. These binder resins may be used singly or in combination of two or more kinds thereof.

In addition, various kinds of inorganic particles such as conductive particles and metal oxide particles can be contained in the intermediate layer for the purpose of adjusting the resistance thereof. For example, it is possible to use particles of various kinds of metal oxides such as alumina, zinc oxide, titanium oxide, tin oxide, antimony oxide, indium oxide, and bismuth oxide and particles of tin doped indium oxide (ITO), antimony-doped tin oxide (ATO), and zirconium oxide.

These inorganic particles can be used singly or in combination of two or more kinds thereof. The metal oxide particles may be in the form of a solid solution or fusion bonding in the case of mixing two or more kinds thereof.

The average primary particle diameter of the inorganic particles is preferably 300 nm or less, more preferably 100 nm or less, and still more preferably 50 nm or less. Meanwhile, the lower limit value of the average primary particle diameter is not particularly limited, but it is preferably 10 nm or more and more preferably 20 nm or more. The average primary particle diameter of the inorganic particles can be measured by the same method as in the p-type semiconductor fine particles.

As the solvent to be used in the coating liquid of the intermediate layer, those that favorably disperse the metal oxide particles as described above and dissolve the binder resin, particularly a polyamide resin are preferable. Specifically, an alcohol having from 1 to 4 carbon atoms such as methanol, ethanol, n-propanol, isopropanol, n-butanol, t-butanol, and sec-butanol is preferable since it enables the polyamide resin to exhibit excellent solubility and coating performance. These solvents may be used singly or in combination of two or more kinds thereof. In addition, it is possible to concurrently use a co-solvent with the solvent described above in order to improve the storage stability and the dispersibility of inorganic particles. Preferred examples of the co-solvent may include benzyl alcohol, toluene, methylene chloride, cyclohexanone, and tetrahydrofuran.

The method of forming the intermediate layer is not particularly limited, but the binder resin is dissolved in the solvent, subsequently the inorganic particles are dispersed in the solution by using a device such as an ultrasonic disperser, a beads mill, a ball mill, a sand mill, or a homomixer to prepare a coating liquid, and this coating liquid is then coated on a conductive support in a desired thickness. Thereafter, the coated layer is dried to complete the intermediate layer. The drying method of the intermediate layer can be appropriately selected depending on the kind of the solvent and the film thickness, but heating drying is preferable.

The concentration of the binder resin in the coating liquid for forming an intermediate layer is appropriately selected according to the film thickness of the intermediate layer and the production rate.

The mixed proportion of the inorganic particles to the binder resin at the time of dispersing the inorganic particles is preferably from 20 to 400 parts by mass and more preferably from 50 to 350 parts by mass with respect to 100 parts by mass of the binder resin.

The dry film thickness of the intermediate layer is preferably from 0.1 to 15 μm and more preferably from 0.3 to 10 μm.

<Image Forming Apparatus>

An embodiment of the present invention also provides an image forming apparatus equipped with the electrophotographic photoreceptor described above.

The image forming apparatus according to an embodiment of the present invention is one that includes (1) at least the electrophotographic photoreceptor having a protective layer of an embodiment of the present invention, (2) a charging unit for charging the surface of the electrophotographic photoreceptor, (3) an exposure unit for conducting image exposure on the surface of the electrophotographic photoreceptor charged by the charging unit to form a latent image, (4) a developing unit for visualizing the latent image formed by the exposure unit to form a toner image, and (5) a transfer unit for transferring the toner image formed on the surface of the electrophotographic photoreceptor by the developing unit onto a transfer medium such as paper or a transfer belt.

Incidentally, it is preferable to use a non-contact charging device as the charging unit for charging the electrophotographic photoreceptor. Examples of the non-contact charging device may include a corona charging device, a corotron charging device, and a scorotron charging device.

Figure 2:
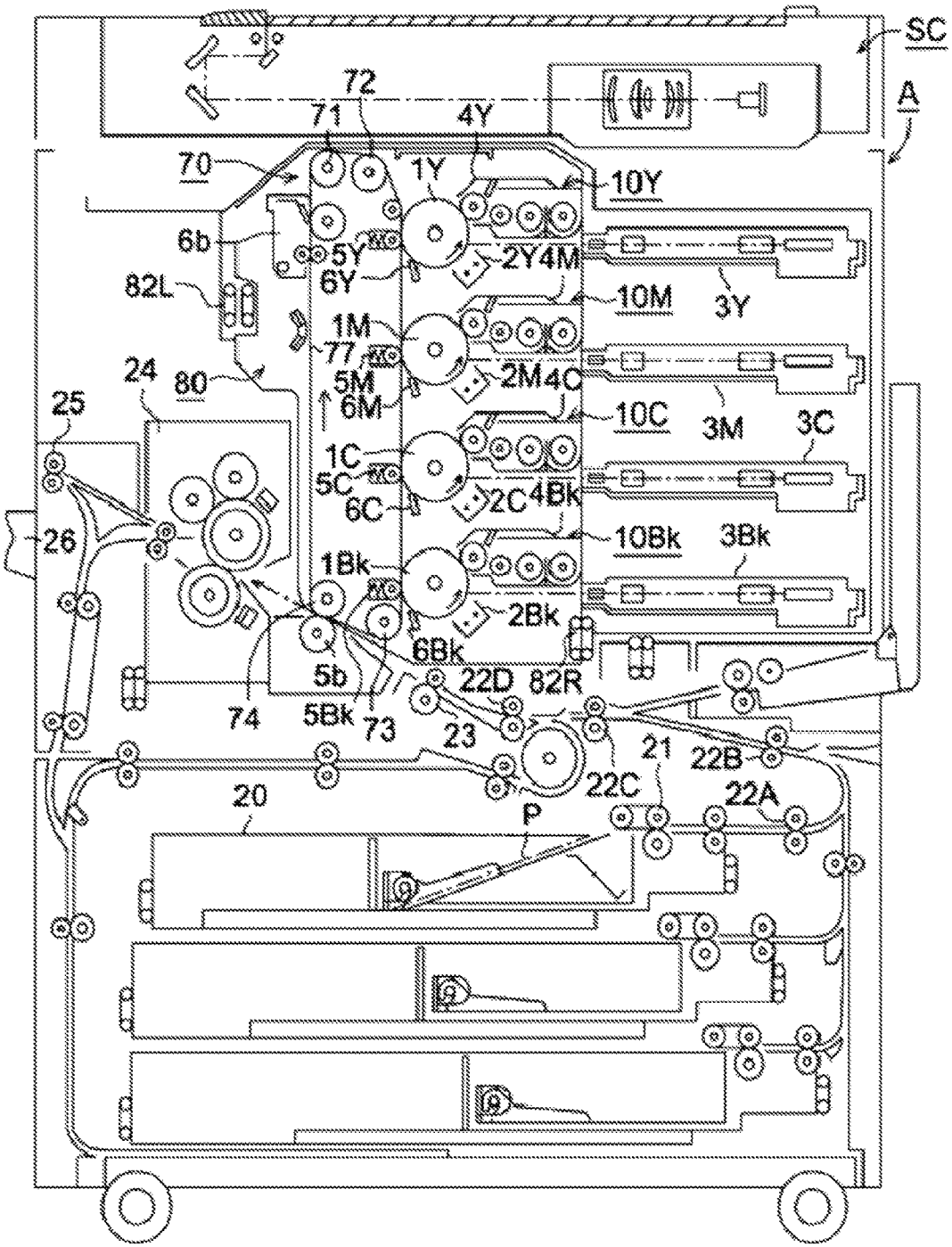
FIG. 2 is a schematic cross-sectional view of a color image forming apparatus illustrating an embodiment of the present invention.

FIG. 2 is a schematic cross-sectional view which illustrates an example of the color image forming apparatus illustrating an embodiment of the present invention.

This color image forming apparatus is referred to as a tandem type color image forming apparatus, and it is configured by four image forming units 10Y, 10M, 10C, and 10Bk, an endless belt-shaped intermediate transfer body unit 70, a paper feeding and conveying unit 21, and a fixing unit 24. An original image reading device SC is disposed at the upper part of the main body A of the image forming apparatus.

The image forming unit 10Y for forming a yellow image includes a charging unit (charging step) 2Y disposed around a drum-shaped photoreceptor 1Y as a first image carrier, an exposure unit (exposure step) 3Y, a developing unit (developing step) 4Y, a primary transfer roller 5Y as a primary transfer unit (primary transfer step), and a cleaning unit 6Y. The image forming unit 10M for forming a magenta image includes a drum-shaped photoreceptor 1M as a first image carrier, a charging unit 2M, an exposure unit 3M, a developing unit 4M, a primary transfer roller 5M as a primary transfer unit, and a cleaning unit 6M. The image forming unit 10C for forming a cyan image includes a drum-shaped photoreceptor 1C as a first image carrier, a charging unit 2C, an exposing unit 3C, a developing unit 4C, a primary transfer roller 5C as a primary transfer unit, and a cleaning unit 6C. The image forming unit 10Bk forming a black image includes a drum-shaped photoreceptor 1Bk as a first image carrier, a charging unit 2Bk, an exposure unit 3Bk, a developing unit 4Bk, a primary transfer roller 5Bk as a primary transfer unit, and a cleaning unit 6Bk.

The four image forming units 10Y, 10M, 10C, and 10Bk are configured by the photoreceptor drums 1Y, 1M, 1C, and 1Bk positioned in the center, the charging units 2Y, 2M, 2C, and 2Bk, the exposure units 3Y, 3M, 3C, and 3Bk, the developing units 4Y, 4M, 4C, and 4Bk, and the cleaning units 6Y, 6M, 6C, and 6Bk for cleaning the photoreceptor drums 1Y, 1M, 1C, and 1Bk.

The image forming units 10Y, 10M, 10C, and 10Bk have the same configuration except that the colors of the toner images respectively formed on the photoreceptors 1Y, 1M, 1C, and 1Bk are different from one another, and the image forming unit 10Y will be described in detail as an example.

In the image forming unit 10Y, the charging unit 2Y (hereinafter, simply referred to as the charging unit 2Y or charging device 2Y), the exposure unit 3Y, the developing unit 4Y, and the cleaning unit 6Y (hereinafter, simply referred to as the cleaning unit 6Y or cleaning blade 6Y) are disposed around the photoreceptor drum 1Y that is an image forming body, and a yellow (Y) toner image is formed on the photoreceptor drum 1Y. In addition, in the present embodiment, at least the photoreceptor drum 1Y, the charging unit 2Y, the developing unit 4Y, and the cleaning unit 6Y in this image forming unit 10Y are provided so as to be integrated.

The charging unit 2Y is a unit for applying a uniform potential to the photoreceptor drum 1Y, and a corona discharge type charging device 2Y is used for the photoreceptor drum 1Y in the present embodiment.

The exposure unit 3Y is a unit for forming an electrostatic latent image corresponding to the yellow image on the photoreceptor drum 1Y to which a uniform potential is applied by the charging unit 2Y by conducting exposure based on the image signal (yellow), and as this exposure unit 3Y, one configured by an LED in which light emitting elements are arranged in an array shape in the axial direction of the photoreceptor drum 1Y and an imaging element (trade name: SELFOC (registered trademark) lens), a laser optical system, or the like is used.

As the image forming apparatus of an embodiment of the present invention, the photoreceptor described above and constituents such as the developing device and the cleaning device may be configured to be integrally combined as a process cartridge (image forming unit) and this image forming unit may be configured to be detachable from the main body of the apparatus. In addition, at least one of the charging device, the image exposure device, the developing device, the transfer or separating device, or the cleaning device may be integrally supported together with the photoreceptor to form a process cartridge (image forming unit), and this process cartridge may be employed as a single image forming unit detachable from the main body of the apparatus and detachably configured by using a guide unit such as a rail of the main body of the apparatus.

The endless belt-shaped intermediate transfer body unit 70 includes an endless belt-shaped intermediate transfer body 77 as a semiconductive endless belt-shaped secondary image carrier that is wound around a plurality of rollers to be rotatably supported.

The images in the respective colors formed by the image forming units 10Y, 10M, 10C, and 10Bk are successively transferred onto the rotating endless belt-shaped intermediate transfer body 77 by the primary transfer rollers 5Y, 5M, 5C, and 5Bk as the primary transfer unit, and a synthesized color image is formed. A transfer material P as a transfer material (support for carrying the fixed final image: for example, plain paper or a transparent sheet) stored in a paper feeding cassette 20 is fed by the paper feeding unit 21 and conveyed to the secondary transfer roller 5*b* as a secondary transfer unit via a plurality of intermediate rollers 22A, 22B, 22C, and 22D and a registration roller 23, and the color image is collectively transferred onto the transfer material P through secondary transfer. The transfer material P to which the color image has been transferred is subjected to the fixing treatment by the fixing unit 24, nipped by a discharge roller 25, and placed on a discharge tray 26 at the outside of the apparatus. Here, a transfer support of the toner image formed on the photoreceptor, such as the intermediate transfer body and the transfer material, is collectively referred to as a transfer medium.

Meanwhile, after the color image is transferred onto the transfer material P by the secondary transfer roller 5*b* as the secondary transfer unit, the toner remaining on the endless belt-shaped intermediate transfer body 77 from which the transfer material P has been curvedly separated is removed by the cleaning unit 6*b*.

During the image forming process, the primary transfer roller 5Bk is always in contact with the photoreceptor 1Bk. The other primary transfer rollers 5Y, 5M, and 5C are brought into contact with the respective corresponding photoreceptors 1Y, 1M, and 1C only when a color image is formed.

The secondary transfer roller 5*b* is brought into contact with the endless belt-shaped intermediate transfer body 77 only when the transfer material P passes through the secondary transfer roller 5*b* and the secondary transfer is thus conducted.

In addition, a housing 80 is configured so as to be capable of being drawn out from the main body A of the apparatus via support rails 82L and 82R.

The housing 80 is configured by the image forming units 10Y, 10M, 10C, and 10Bk and the endless belt-shaped intermediate transfer body unit 70.

The image forming units 10Y, 10M, 10C, and 10Bk are vertically arranged in tandem. The endless belt-shaped intermediate transfer body unit 70 is disposed on the left side of the photoreceptors 1Y, 1M, 1C, and 1Bk in the drawing. The endless belt-shaped intermediate transfer body unit 70 is configured by the endless belt-shaped intermediate transfer body 77 that is wound around a plurality of rollers 71, 72, 73, and 74 to be rotatably supported, the primary transfer rollers 5Y, 5M, 5C, and 5Bk, and the cleaning unit 6*b*.

An embodiment of the present invention also provides an image forming method in which an electrophotographic image is formed by using the image forming apparatus described above. According to the image forming method of an embodiment of the present invention, it is possible to stably forma favorable electrophotographic image over a long period of time.

EXAMPLES

The effect of the present invention will be described with reference to the following Examples and Comparative Examples. However, the technical scope of the present invention is not limited to only the following Examples. Incidentally, in the following Examples, the operations were conducted at room temperature (20 to 25° C.) unless otherwise stated. In addition, the terms "%" and "parts" mean "% by mass" and "parts by mass", respectively, unless otherwise stated.

<Preparation of p-type Semiconductor Fine Particles>

Production Example 1-1

Preparation of p-type Semiconductor Fine Particles 1

$Al_2O_3$ and $Cu_2O$ were mixed at a molar ratio of 1:1, sintered in an Ar atmosphere at a temperature of 1100° C. for 4 days, molded into a pellet shape, and further sintered at 1100° C. for 2 days, thereby obtaining a sintered body. Thereafter, the sintered body was coarsely pulverized to have a size of several hundred micrometers, and the coarse particles thus obtained were pulverized with a solvent by using a wet media dispersion type apparatus, thereby obtaining $CuAlO_2$ fine particles having a number average primary particle diameter of 20 nm. Incidentally, the number average primary particle diameter of the $CuAlO_2$ fine particles was calculated by analyzing a photographic image (excluding aggregated particles) obtained by taking a photograph of the $CuAlO_2$ fine particles enlarged by 100,000-fold by a scanning electron microscope (JSM-7500F manufactured by JEOL Ltd.) and randomly scanning 300 particles in the photograph by a scanner by an automatic image processing and analysis system ("Luzex AP" software Ver. 1.32 developed by Nireco Corporation). Incidentally, the number average primary particle diameter of the p-type semiconductor fine particles obtained in the following Production Examples was also measured by the same method.

In a wet sand mill (alumina beads having a diameter of 0.5 mm), 100 parts by mass of the $CuAlO_2$ fine particles thus obtained, 30 parts by mass of 3-methacryloxypropyltrimethoxysilane "KBM-503" (manufactured by Shin-Etsu Chemical Co., Ltd.) as a surface treatment agent, and 1000 parts by mass of methyl ethyl ketone were put and mixed at 30° C. for 6 hours, thereafter, the methyl ethyl ketone and the alumina beads were separated through filtration, and the residue was dried at 60° C., thereby preparing p-type semiconductor fine particles 1.

Production Example 1-2

Preparation of p-type Semiconductor Fine Particles 2

$In_2O_3$ and $Cu_2O$ were mixed at a molar ratio of 1:1, sintered in an Ar atmosphere at a temperature of 1100° C. for 4 days, molded into a pellet shape, and further sintered at 1100° C. for 2 days, thereby obtaining a sintered body. Thereafter, the sintered body was coarsely pulverized to have a size of several hundred micrometers, and the coarse particles thus obtained were pulverized with a solvent by using a wet media dispersion type apparatus, thereby obtaining $CuInO_2$ fine particles having a number average primary particle diameter of 20 nm. The $CuInO_2$ fine particles thus obtained were subjected to a surface treatment by the same method as in Production Example 1-1, thereby preparing p-type semiconductor fine particles 2.

Production Example 1-3

Preparation of p-type Semiconductor Fine Particles 3

$SrCu_2O_2$ fine particles were fabricated with reference to JP 2014-170006 A and JP 2003-286096 A. Specifically, strontium oxide (SrO) and copper oxide (CuO) were mixed at a molar ratio of 3:7, heated and melted at 1000° C. or higher in an atmosphere in which oxygen was mixed in nitrogen at 5% or less, and brought into contact with a seed crystal represented by a general formula $SrCu_2O_2$ while keeping the temperature at 1000° C. or higher, and a $SrCu_2O_2$ single crystal was obtained by a flux pulling method. $SrCu_2O_2$ fine particles having a number average primary particle diameter of 20 nm were obtained by pulverizing and sieving (classifying) the single crystal. The $SrCu_2O_2$ fine particles thus obtained were subjected to a surface treatment by the same method as in Production Example 1-1, thereby preparing p-type semiconductor fine particles 3.

Production Example 1-4

Preparation of p-type Semiconductor Fine Particles 4

$BaCu_2O_2$ fine particles having a number average primary particle diameter of 20 nm were obtained in the same manner as in Production Example 1-3 except that strontium oxide (SrO) in Production Example 1-3 was changed to barium oxide (BaO). The $BaCu_2O_2$ fine particles thus obtained were subjected to a surface treatment by the same method as in Production Example 1-1, thereby preparing p-type semiconductor fine particles 4.

Production Example 1-5

Preparation of p-type Semiconductor Fine Particles 5

CuNbO fine particles were fabricated with reference to JP 2015-129765 A and JP 2011-174167 A. Specifically, copper oxide ($Cu_2O$) and niobium pentoxide ($Nb_2O_5$) were thoroughly mixed at a molar ratio of 1:1, subsequently, the powder of this mixture was compression molded at 35 MPa by using a tablet molding machine to obtain a molded product of an oxide. Furthermore, this molded product was sintered in a nitrogen atmosphere for 4 hours by using a muffle furnace heated at 950° C. in a state of being placed on the powder of the above-described mixture placed on an alumina plate, thereby obtaining a sintered body. Subsequently, an oxide film was precipitated and grown on a borosilicate glass substrate by using the sintered body thus obtained as a target and a pulsed laser deposition apparatus, subjected to an annealing step, thereby obtaining an oxide film by a composite oxide of Nb and Cu. Thereafter, this oxide film was separated from the borosilicate glass substrate, pulverized, and classified to obtain Cu.Nb composite oxide (CuNbO) fine particles having a number average primary particle diameter of 30 nm. The CuNbO fine particles thus obtained were subjected to a surface treatment by the same method as in Production Example 1-1, thereby preparing p-type semiconductor fine particles 5.

Production Example 1-6

Preparation of p-type Semiconductor Fine Particles 6

Cu.Ta composite oxide (CuTaO) fine particles having a number average primary particle diameter of 30 nm were obtained in the same manner as in Production Example 1-5 except that niobium pentoxide ($Nb_2O_5$) in Production Example 1-5 was changed to tantalum pentoxide ($Ta_2O_5$). The CuTaO fine particles thus obtained were subjected to a surface treatment by the same method as in Production Example 1-1, thereby preparing p-type semiconductor fine particles 6.

Production Example 1-7

Preparation of p-type Semiconductor Fine Particles 7 p-type semiconductor fine particles 7 were prepared in the same manner as in Production Example 1-1 except that the surface treatment agent KBM-503 was changed to 3-acryloxypropyltrimethoxysilane "KBM-5103" (manufactured by Shin-Etsu Chemical Co., Ltd.) in Production Example 1-1.

Production Example 1-8

Preparation of n-type Semiconductor Fine Particles 1

Tin oxide ($SnO_2$) fine particles (manufactured by C.I. KASEI CO., LTD.) having a number average primary particle diameter of 20 nm were subjected to a surface treatment by the same method as in Production Example 1-1, thereby preparing n-type semiconductor fine particles 1.

<Synthesis of n-type Organic Semiconductor>

Production Example 2-1

Synthesis of ETM 01

In a four-necked flask, 300 parts by mass of pyromellitic dianhydride, 560 parts by mass of 2-(trifluoromethyl)aniline, and dimethylformamide were put and heated while being refluxed for 3 hours. After being cooled, the reaction mixture was filtered, and the precipitate was washed with dimethylformamide, further washed with ether, and dried. This product was purified by using a silica gel column to obtain a compound represented by the following Chemical Formula (ETM 01). It was confirmed that the intended product was obtained by subjecting the compound thus obtained to NMR, IR, MS, and elemental analyses.

[Chemical Formula 27]

ETM01

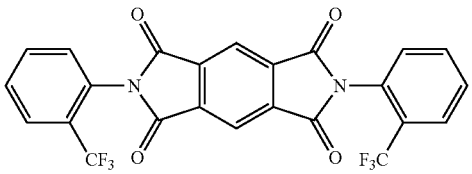

Production Example 2-2

Synthesis of ETM 02

A compound represented by the following Chemical Formula (ETM 02) was synthesized in the same manner as in Production Example 2-1 except that 560 parts by mass of 2-(trifluoromethyl) aniline was changed to 300 parts by mass of 1,2-dimethylpropylamine in Production Example 2-1.

[Chemical Formula 28]

ETM02

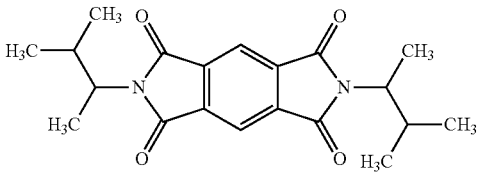

Production Example 2-3

Synthesis of ETM 03

A compound ETM 03 represented by the following Chemical Formula was synthesized in the same manner as in Production Example 2-1 except that 300 parts by mass of pyromellitic dianhydride was changed to 300 parts by mass of 3,3',4,4'-biphenyltetracarboxylic dianhydride, and 560 parts by mass of 2-(trifluoromethyl)aniline was changed to 310 parts by mass of 2,6-dimethylaniline in Production Example 2-1.

[Chemical Formula 29]

ETM03

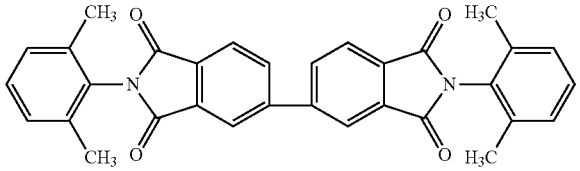

Production Example 2-4

Synthesis of ETM 04

A compound ETM 04 represented by the following Chemical Formula was synthesized in the same manner as in Production Example 2-1 except that 300 parts by mass of pyromellitic dianhydride was changed to 300 parts by mass of naphthalene-1,4,5,8-tetracarboxylic dianhydride and 560 parts by mass of 2-(trifluoromethyl)aniline was changed to 600 parts by mass of pentyl 4-aminocyclohexanecarboxylate in Production Example 2-1.

[Chemical Formula 30]

ETM04

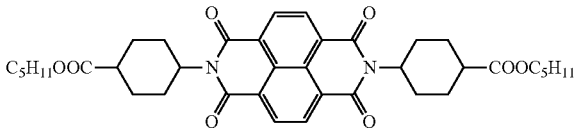

Production Example 2-5

Synthesis of ETM 05

A compound ETM 05 represented by the following Chemical Formula was synthesized in the same manner as in Production Example 2-1 except that 300 parts by mass of pyromellitic dianhydride was changed to 300 parts by mass of perylene-3,4,9,10-tetracarboxylic dianhydride and 560 parts by mass of 2-(trifluoromethyl)aniline was changed to 390 parts by mass of 1-hexylheptylamine in Production Example 2-1.

[Chemical Formula 31]

ETM05

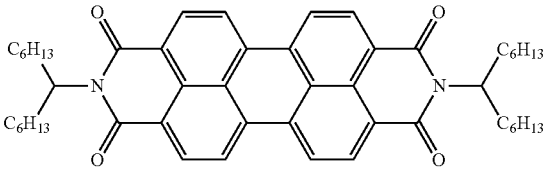

Production Example 2-6

Synthesis of ETM 06

(Synthesis of ETM 06a)

In a four-necked flask, 60 parts by mass of 1,5-benzoylnaphthalene and diethylene glycol were put and dissolved, and 37.1 parts by mass of hydrazine monohydrate (80%) was added thereto, and the mixture was heated. After the mixture was refluxed at 160° C. for 4 hours, the resultant was cooled to 100° C., 24 parts by mass of sodium hydroxide was added thereto, and the mixture was heated. The mixture was refluxed at from 160° C. to 200° C. for further 4 hours and left to cool to precipitate a crystal. The needle crystal thus precipitated was separated through filtration, washed with methanol, and recrystallized from a mixed solvent of hexane/dichloromethane=4/1 (volume ratio), thereby obtaining ETM 06a.

(Synthesis of ETM 06b)

In a four-necked flask, 150 parts by mass of anhydrous maleic acid and nitrobenzene were put and dehydrated while being heated and refluxed. Thereto, 31 parts by mass of ETM 06a and 0.5 part by mass of iodine were added, and the mixture was heated at 200° C. for 5 hours. Thereafter, nitrobenzene was recovered therefrom through vacuum distillation by about ⅔, and the residue was left to cool. Acetic acid was added thereto to precipitate a crystal, and the crystal thus precipitated was separated through filtration. The crude crystal thus separated through filtration was washed with acetic acid and acetone, dried, and purified through sublimation, thereby obtaining ETM 06b.

(Synthesis of ETM 06)

A compound ETM 06 represented by the following Chemical Formula was synthesized in the same manner as in Production Example 2-1 except that 300 parts by mass of pyromellitic dianhydride was changed to 300 parts by mass of the ETM 06b described above and 560 parts by mass of 2-(trifluoromethyl) aniline was changed to 132 parts by mass of 1,2-dimethylpropylamine in Production Example 2-1.

[Chemical Formula 32]

ETM06

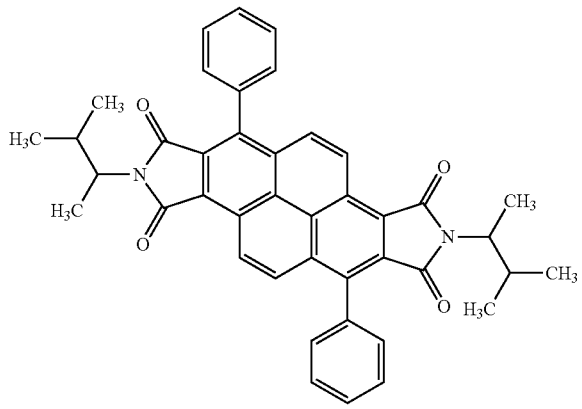

Production Example 2-7

Synthesis of ETM 201

ETM 201 was synthesized according to the following scheme.

[Chemical Formula 33]

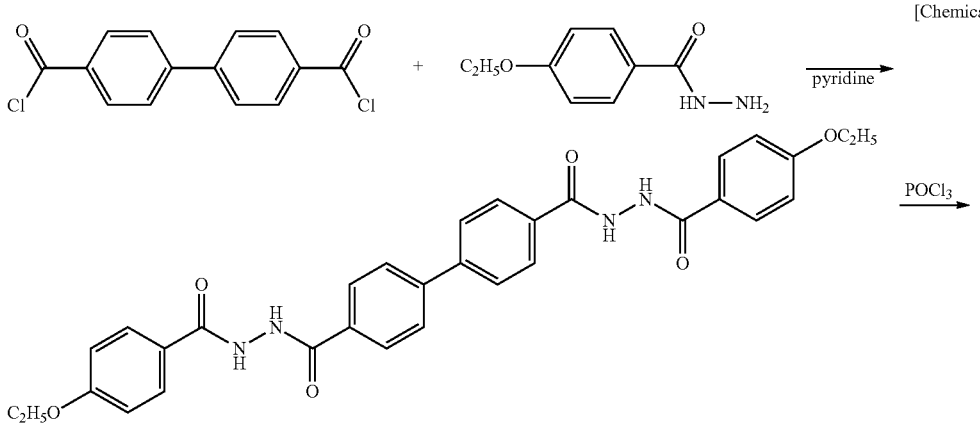

ETM201a

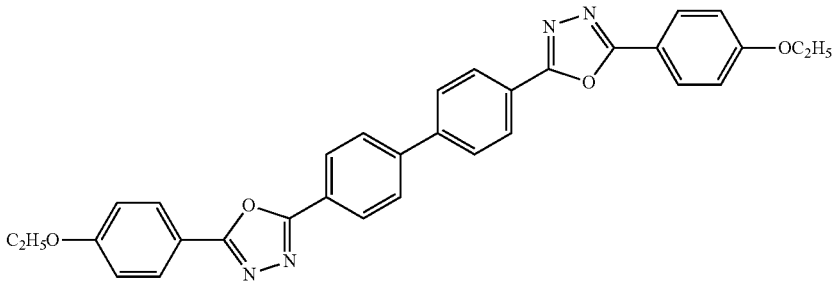

ETM201

(Synthesis of ETM 201a)

In a four-necked flask, 10 parts by mass of [1,1'-biphenyl]-4,4'-dicarboxylic acid dichloride, 13.9 parts by mass of 4-ethoxybenzohydrazide, and anhydrous pyridine were put and reacted. The reaction mixture was poured into pure water and the precipitate was filtered. The precipitate was washed with dilute hydrochloric acid and pure water and then recrystallized from a mixed solvent of methanol/ethanol, thereby obtaining ETM 201a as a needle crystal.

(Synthesis of ETM 201)

In 812 parts by mass of phosphorus oxychloride, 15 parts by mass of ETM 201a was reacted through reflux. After the phosphorus oxychloride was distilled off, the reaction product was thoroughly washed with water and methanol. Subsequently, this was recrystallized from a mixed solvent of ethanol/toluene, thereby obtaining ETM 201.

Production Example 2-8

Synthesis of ETM 401

ETM 401 was synthesized according to the following scheme.

[Chemical Formula 34]

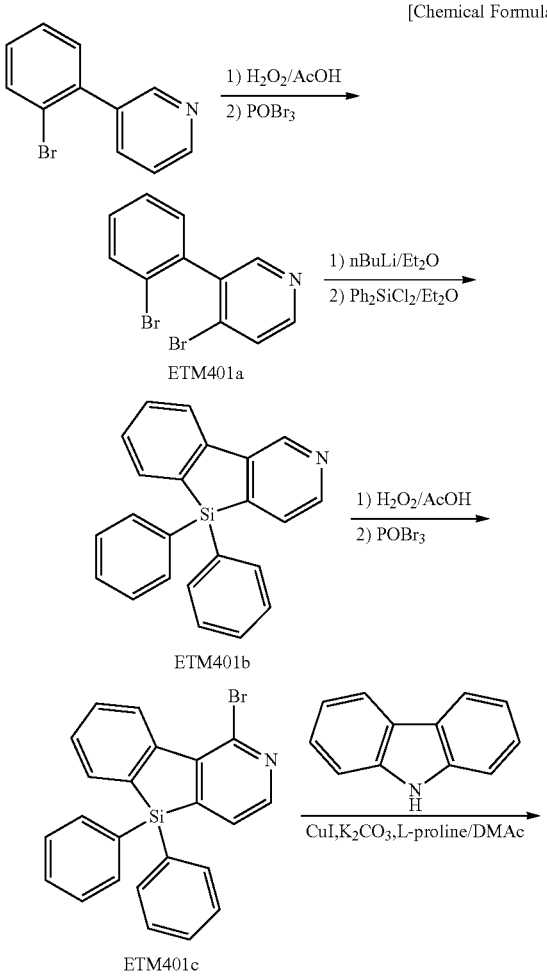

-continued

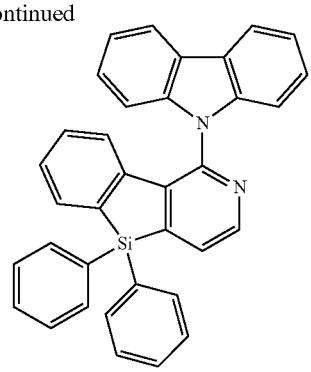

ETM401

(Synthesis of ETM 401a)

In acetic acid, 23.4 parts by mass of 3-(2-bromophenyl) pyridine synthesized according to a reference literature (J. Org. Chem., 2002, VOL. 67, 9392-9396) was dissolved, 113.4 parts by mass of 30% hydrogen peroxide was added thereto, and the mixture was heated and stirred at 95° C. for 5 hours. The reaction mixture was concentrated to about 90% under reduced pressure, a 1% aqueous solution of sodium bicarbonate was added to the residue, and the organic layer was extracted with ethyl acetate. The organic layer was washed with saturated saline solution three times and concentrated under reduced pressure. Chloroform was added to the residue, 43.0 parts by mass of phosphorus oxybromide was added thereto, and the mixture was heated and refluxed for 3 hours. The solvent and excess phosphorus oxybromide were distilled off under reduced pressure, and the residue was recrystallized from toluene, thereby obtaining ETM 401a.

(Synthesis of ETM 401b)

In a four-necked flask, 25.0 parts by mass of ETM 401a was dissolved in dehydrated ether, and the internal temperature was cooled to −75° C. Next, 75.1 parts by mass of 1.6 M n-butyllithium/hexane solution was gradually added thereto while keeping the internal temperature at −70° C. or lower. After the addition, the mixture was stirred at the same temperature for 2 hours, and a solution prepared by dissolving 21.2 parts by mass of dichlorodiphenylsilane in dehydrated ether was then gradually added to the resultant while keeping the internal temperature at −65° C. or lower. After being stirred at the same temperature for 3 hours, the resultant was left to stand so as to warm to room temperature and further stirred for 2 hours. After the reaction was completed, the solvent was distilled off under reduced pressure, and the residue was recrystallized from a mixed solvent of methylene chloride and ethanol, thereby obtaining ETM 401b.

(Synthesis of ETM 401c)

In a four-necked flask, 20.0 parts by mass of ETM 401b was dissolved in acetic acid, 67.6 parts by mass of 30% hydrogen peroxide was added thereto, and the mixture was heated and stirred at 95° C. for 5 hours. The reaction mixture was concentrated to about 90% under reduced pressure, a 1% aqueous solution of sodium bicarbonate was added to the residue, and the organic layer was extracted with ethyl acetate. The organic layer was washed with saturated saline solution three times and concentrated under reduced pressure. Chloroform was added to the residue, 25.6 parts by mass of phosphorus oxybromide was added thereto, and the mixture was heated and refluxed for 3 hours. The solvent and excess phosphorus oxybromide were distilled off under reduced pressure, and the residue was recrystallized from toluene, thereby obtaining ETM 401c.

(Synthesis of ETM 401)

In a four-necked flask, 23.0 parts by mass of ETM 401c was dissolved in DMAc, 34.1 parts by mass of carbazole, 23.3 parts by mass of copper iodide, 16.9 parts by mass of potassium carbonate, and 1.3 parts by mass of L-proline were added thereto, and the mixture was heated and stirred in a nitrogen stream for 6 hours at the internal temperature of 150° C. After the reaction was completed, the solvent was distilled off under reduced pressure, and the residue was purified by silica gel column chromatography (eluent=heptane:methylene chloride=9:1 (volume ratio)), thereby obtaining a white powder of ETM 401. The structure thereof was identified by a nuclear magnetic resonance ($^{1}$H-NMR, $^{13}$C-NMR, and the like) method and MASS spectrum (mass spectrometry).

Production Example 2-9

Synthesis of ETM 501

ETM 501 was synthesized according to the following scheme.

[Chemical Formula 35]

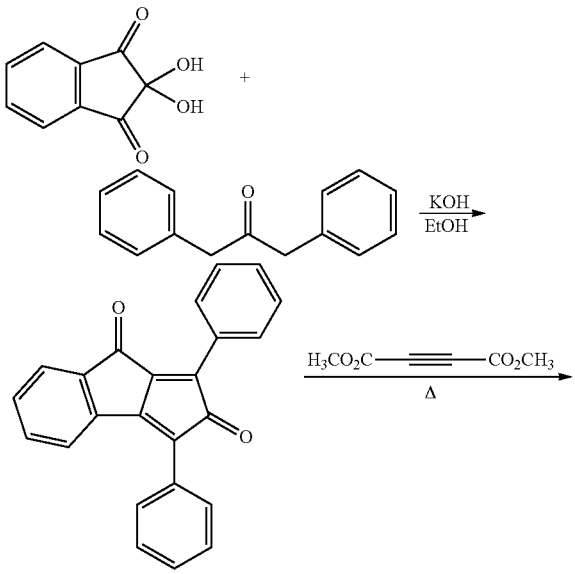

ETM501a

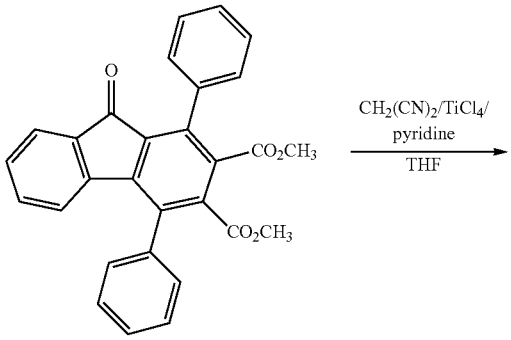

ETM501b

-continued

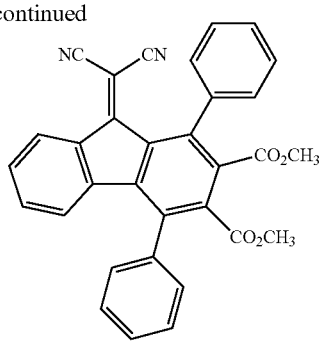

ETM501

(Synthesis of ETM 501a)

In a four-necked flask, 100 parts by mass of ninhydrin and 118 parts by mass of 1,3-diphenyl-2-propanone were added to ethanol and heated until to be refluxed. A methanol solution in which 9.5 parts by mass of potassium hydroxide was dissolved was added dropwise to the reaction mixture being refluxed over 1 hour. After the dropwise addition, the resultant was refluxed and stirred for 1 hour, and left to cool so as to precipitate a crystal, and the crystal was separated through filtration and washed with methanol. The crystal was recrystallized from acetonitrile, thereby obtaining ETM 501a.

(Synthesis of ETM 501b)

In a flask, 130 parts by mass of ETM 501a and 82.9 parts by mass of dimethyl acetylenedicarboxylate were put, the external temperature was set to 160° C., and the reaction mixture was heated. After the internal temperature reached 130° C. or higher, the mixture was heated and stirred for 2 hours, then left to cool, and the crystal thus precipitated was separated through filtration. Ethanol and toluene were added to the crude crystal for recrystallization, thereby obtaining ETM 501b.

(Synthesis of ETM 501)

In a four-necked flask, 155 parts by mass of ETM 501b and 45.7 parts by mass of malononitrile were added to THF and cooled at an external temperature of −10° C. At an internal temperature of 0° C.±5° C., 328 parts by mass of titanium tetrachloride dissolved in carbon tetrachloride was added thereto dropwise. After the resultant was stirred at the same temperature for 30 minutes, 274 parts by mass of pyridine was added thereto. The temperature was gradually returned to room temperature, and the resultant was further heated to be refluxed. After the resultant was allowed to react for 8 hours in a state of being refluxed, the temperature was returned to room temperature, the reaction mixture was then added to pure water, toluene was further added thereto, and the toluene layer was extracted through liquid separation. The toluene layer was washed with dilute hydrochloric acid, and then washed with water until the pH of the aqueous layer became neutral. The toluene layer was concentrated through vacuum distillation and recrystallized by adding a mixed solution of toluene and ethanol. The crystal was separated through filtration and recrystallized again, thereby obtaining ETM 501.

<Fabrication of Electrophotographic Photoreceptor>

Example 1

[Conductive Support]

The surface of an aluminum cylindrical body having a diameter of 80 mm was subjected to cutting to prepare a conductive support having a finely roughened surface. An intermediate layer, a photosensitive layer, and a protective layer were sequentially layered on the conductive support by the following method to fabricate an electrophotographic photoreceptor.

[Fabrication of Intermediate Layer]

(Preparation of Metal Oxide Fine Particles [1])

After 500 parts by mass of rutile type titanium oxide "MT-500SA" (manufactured by TAYCA CORPORATION) having a number average primary particle diameter of 35 nm, a surface treatment agent: 65 parts by mass of 3-methacryloxypropyltrimethoxysilane "KBM-503" (manufactured by Shin-Etsu Chemical Co., Ltd.), and 1,500 parts by mass of toluene were stirred and mixed, the mixture was subjected to a wet crushing treatment at a retention time in the mill of 25 minutes and a temperature of 35° C. by a bead mill, and toluene was separated and removed from the slurry thus obtained through vacuum distillation. The dried product thus obtained was heated at 120° C. for 2 hours to bake the surface treatment agent. Thereafter, the resultant was pulverized by a pin mill, thereby obtaining metal oxide fine particles [1] composed of organically treated rutile type titanium oxide.

(Preparation of Metal Oxide Fine Particles [2])

Metal oxide fine particles [2] composed of organically treated rutile type titanium oxide was obtained in the same manner as in the preparation of metal oxide fine particles [1] described above except that methyl hydrogen polysiloxane (MHPS): 1,1,1,3,5,5,5-heptamethyltrisiloxane (manufactured by Shin-Etsu Chemical Co., Ltd.) was used instead of 3-methacryloxypropyltrimethoxysilane as a surface treatment agent.

To 1,700 parts by mass of a mixed solvent of ethanol/n-propanol/tetrahydrofuran (volume ratio 45/20/35), 100 parts by mass of a polyamide resin (N−1) represented by the following formula was added and stirred and mixed at 20° C., and 97 parts by mass of the metal oxide fine particles [1] and 226 parts by mass of the metal oxide fine particles [2] were added to this solution and dispersed therein by using a bead mill and setting the retention time in the mill to 5 hours. This solution was allowed to stand still for a whole day and night and then filtered at a pressure of 50 kPa by using the Rigimesh 5 μm filter manufactured by Pall Corporation, thereby preparing a coating liquid for forming an intermediate layer.

The coating liquid for forming an intermediate layer thus obtained was coated on the outer circumferential surface of the cleaned conductive support by a dip coating method and dried at 120° C. for 30 minutes, thereby forming an intermediate layer having a dry film thickness of 2 μm.

[Chemical Formula 36]

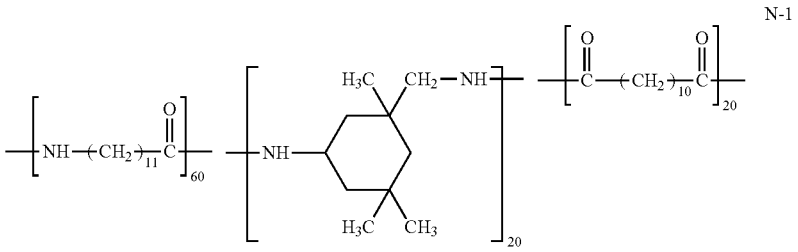

[Fabrication of Photosensitive Layer]

(Fabrication of Charge Generating Layer)

<<Synthesis of Pigment (CG-1)>>

(1) Synthesis of Amorphous Titanyl Phthalocyanine

Crude titanyl phthalocyanine was synthesized from 1,3-diiminoisoindoline and titanium tetra-n-butoxide, and a solution prepared by dissolving the crude titanyl phthalocyanine thus obtained in sulfuric acid was poured into water to precipitate a crystal. This solution was filtered, and the crystal thus obtained was then thoroughly washed with water to obtain a wet paste product. Subsequently, the wet paste product was frozen in a freezer, thawed again, then filtered, and dried, thereby obtaining amorphous titanyl phthalocyanine.

Synthesis of Titanyl Phthalocyanine of (2R,3R)-2,3-Butanediol Adduct (CG-1)

The amorphous titanyl phthalocyanine thus obtained and (2R,3R)-2,3-butanediol were mixed in o-dichlorobenzene (ODB) so that the equivalent ratio of (2R,3R)-2,3-butanediol to amorphous titanyl phthalocyanine was 0.6. The mixture thus obtained was heated and stirred at from 60 to 70° C. for 6 hours, and the solution thus obtained was allowed to stand still for the night, and methanol was then further added thereto to precipitate a crystal. This solution was filtered, the crystal thus obtained was washed with methanol, thereby obtaining a charge generating material (CG-1) composed of a pigment containing titanyl phthalocyanine of (2R,3R)-2,3-butanediol adduct.

The X-ray diffraction spectrum of the charge generating material (CG-1) was measured, and as a result, peaks were observed at 8.3°, 24.7°, 25.1°, and 26.5°. It is presumed that the charge generating material (CG-1) thus obtained is a mixture of a 1:1 adduct of titanyl phthalocyanine and (2R,3R)-2,3-butanediol and titanyl phthalocyanine (non-adduct).

<<Formation of Charge Generating Layer>>

The following components were mixed and dispersed for 0.5 hour at a circulation flow rate of 40 L/h by using the circulation type ultrasonic homogenizer "RUS-600TCVP" (manufactured by NISSEI Corporation, 19.5 kHz, 600 W) to prepare a coating liquid for forming a charge generating layer:

charge generating material (CG-1) 24 parts by mass, polyvinyl butyral resin S-LEC (registered trademark) BL-1 (manufactured by SEKISUI CHEMICAL CO., LTD.) 12 parts by mass, and solvent: methyl ethyl ketone/cyclohexanone=4/1 (V/V) 400 parts by mass.

This coating liquid for forming a charge generating layer was coated on the intermediate layer described above by a dip coating method to form a coating film, and this coating film was dried, thereby forming a charge generating layer having a layer thickness of 0.5 μm.

(Fabrication of Charge Transport Layer)

A coating liquid for forming a charge transport layer was prepared by mixing and dissolving 225 parts by mass of a charge transport material: 4,4'-dimethyl-4"-(β-phenylstyryl) triphenylamine, 300 parts by mass of a binder resin: polycarbonate resin "Z 300" (manufactured by MITSUBISHI GAS CHEMICAL COMPANY, INC.), 6 parts by mass of an antioxidant: "Irganox (registered trademark) 1010" (manufactured by BASF SE), 1600 parts by mass of a solvent: THF (tetrahydrofuran), 400 parts by mass of a solvent: toluene, and 1 part by mass of silicone oil "KF-50" (manufactured by Shin-Etsu Chemical Co., Ltd.). This coating liquid for forming a charge transport layer was coated on the charge generating layer by a dip coating method, thereby forming a charge transport layer having a dry film thickness of 20 μm.

[Formation of Protective Layer]

A coating solution for forming a protective layer (curable composition) was prepared by mixing and stirring the following components so as to be sufficiently dissolved and dispersed:

p-type metal oxide fine particles 1 100 parts by mass,

ETM 01 10 parts by mass, trimethylolpropane trimethacrylate (manufactured by Sartomer Company) 100 parts by mass, Irgacure (registered trademark) 819 (manufactured by BASF SE) 15 parts by mass, and 2-butanol 500 parts by mass.

This coating liquid for forming a protective layer was coated on the charge transport layer by using a circular slide hopper coater to form a coating film. This coating film was dried at room temperature for 20 minutes and then irradiated with light having a wavelength of 365 nm (intensity: 4000 mW/cm$^2$, radiation intensity of light on coating film: 1800 mW/cm$^2$) for 1 minute at a lamp output of 4 kW in a nitrogen stream having a nitrogen flow rate of 13.5 L/min by using a xenon lamp as the light source and setting the distance between the light source and the surface of the coating film to 5 mm, thereby forming a protective layer having a layer thickness of 2.0 μm, and a photoreceptor 1 was thus fabricated.

Example 2

A photoreceptor 2 was fabricated in the same manner as in Example 1 except that ETM 01 in the coating liquid for forming a protective layer was changed to ETM 02.

Example 3

A photoreceptor 3 was fabricated in the same manner as in Example 1 except that ETM 01 in the coating liquid for forming a protective layer was changed to ETM 03.

Example 4

A photoreceptor 4 was fabricated in the same manner as in Example 1 except that ETM 01 in the coating liquid for forming a protective layer was changed to ETM 04.

Example 5

A photoreceptor 5 was fabricated in the same manner as in Example 1 except that the p-type semiconductor fine particles 1 in the coating liquid for forming a protective layer was changed to the p-type semiconductor fine particles 3.

Example 6

A photoreceptor 6 was fabricated in the same manner as in Example 5 except that ETM 01 in the coating liquid for forming a protective layer was changed to ETM 05.

Example 7

A photoreceptor 7 was fabricated in the same manner as in Example 2 except that the p-type semiconductor fine particles 1 in the coating liquid for forming a protective layer was changed to the p-type semiconductor fine particles 2.

Example 8

A photoreceptor 8 was fabricated in the same manner as in Example 2 except that the p-type semiconductor fine particles 1 in the coating liquid for forming a protective layer was changed to the p-type semiconductor fine particles 4.

Example 9

A photoreceptor 9 was fabricated in the same manner as in Example 2 except that the p-type semiconductor fine particles 1 in the coating liquid for forming a protective layer was changed to the p-type semiconductor fine particles 5.

Example 10

A photoreceptor 10 was fabricated in the same manner as in Example 1 except that the p-type semiconductor fine particles 1 in the coating liquid for forming a protective layer was changed to the p-type semiconductor fine particles 6.

Example 11

A photoreceptor 11 was fabricated in the same manner as in Example 1 except that ETM 01 in the coating liquid for forming a protective layer was changed to ETM 06.

Example 12

A photoreceptor 12 was fabricated in the same manner as in Example 1 except that ETM 01 in the coating liquid for forming a protective layer was changed to ETM 201.

Example 13

A photoreceptor 13 was fabricated in the same manner as in Example 1 except that ETM 01 in the coating liquid for forming a protective layer was changed to 3,3',5,5'-tetra-tert-butyl-4,4'-diphenoquinone (ETM 311) manufactured by Sigma-Aldrich Co., LLC.

[Chemical Formula 37]

ETM311

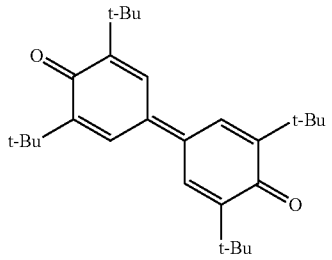

Example 14

A photoreceptor 14 was fabricated in the same manner as in Example 1 except that ETM 01 in the coating liquid for forming a protective layer was changed to ETM 401.

Example 15

A photoreceptor 15 was fabricated in the same manner as in Example 1 except that ETM 01 in the coating liquid for forming a protective layer was changed to ETM 501.

Example 16

A photoreceptor 16 was fabricated in the same manner as in Example 2 except that the p-type semiconductor fine particles 1 in the coating liquid for forming a protective layer was changed to the p-type semiconductor fine particles 7.

Example 17

A photoreceptor 17 was fabricated in the same manner as in Example 1 except that the amount of ETM 01 added was changed to 5 parts by mass, and instead, ETM 02 was added in an amount of 5 parts by mass at the time of preparing the coating liquid for forming a protective layer.

Example 18

A photoreceptor 18 was fabricated in the same manner as in Example 2 except that the amount of the p-type semiconductor fine particles 1 added was changed to 50 parts by mass, and instead, the p-type semiconductor fine particles 3 were added in an amount of 50 parts by mass at the time of preparing the coating liquid for forming a protective layer.

Example 19

A photoreceptor 19 was fabricated in the same manner as in Example 1 except that the amount of the p-type semiconductor fine particles 1 added was changed to 50 parts by mass, and instead, the n-type semiconductor fine particles 1 were added in an amount of 50 parts by mass at the time of preparing the coating liquid for forming a protective layer.

Comparative Example 1

A photoreceptor 20 was fabricated in the same manner as in Example 1 except that ETM 01 was not added at the time of preparing the coating liquid for forming a protective layer.

Comparative Example 2

A photoreceptor 21 was fabricated in the same manner as in Example 1 except that the p-type semiconductor fine particles 1 were not added at the time of preparing the coating liquid for forming a protective layer.

Comparative Example 3

A photoreceptor 22 was fabricated in the same manner as in Example 19 except that ETM 01 was not added at the time of preparing the coating liquid for forming a protective layer.

<Performance Evaluation of Photoreceptor>

The respective photoreceptors obtained in Examples and Comparative Examples were subjected to the following evaluations.

[Surface Hardness]

The surface hardness (universal hardness value) of the respective photoreceptors was measured by using an ultra-micro hardness tester HM-2000 (manufactured by Fisher Technology, Inc.). Specifically, a load was applied to the surface of the photoreceptor at 2 mN for 10 seconds, and the photoreceptor was returned to the initial state by applying a load of 2 mN over 10 seconds again after the creep time for 5 seconds. The photoreceptor does not have a problem in durability when the value of the film hardness is 150 $N/mm^2$ or more.

[Image Evaluation]

As an evaluation machine, one fabricated by modifying the "bizhub PRO (registered trademark) C8000" which was manufactured by Konica Minolta, Inc. and basically had the configuration illustrated in FIG. 1 to have a printing speed of 120 sheets/min was used. The respective photoreceptors were mounted on the evaluation machine, and the image performance (residual potential, image memory, dot reproducibility, and fog) thereof was evaluated.

(Residual Potential (ΔVi))

The photoreceptors 1 to 22 were mounted on the evaluation machine, respectively, and first, the internal mounting pattern No. 53/Dot 1 (a representative exposure pattern formed in a dot shape exhibiting regularity) was continuously printed on a transfer material "POD gross coat" (A3 size, 100 $g/m^2$) (manufactured by OJI PAPER CO., LTD.) by 100 sheets at a density indicating value of 255 and a black position in a low temperature and low humidity environment having a temperature of 10° C. and a relative humidity of 20% RH. A difference ΔVi1 between the potential after exposure of this first sheet and the potential after exposure of the 100th sheet was calculated. Subsequently, a printing durability test that an image under the same condition was continuously printed by 500,000 sheets was conducted, and thereafter an image under the same condition was further continuously printed by 100 sheets. A difference ΔVi2 between the potential after exposure of this first sheet and the potential after exposure of the 100th sheet was calculated. The residual potential was evaluated from ΔVi1 and ΔVi2 according to the following evaluation criteria. The results are presented in Table 1.

The potential after exposure was measured in an environment having a temperature of 10° C. and a relative humidity of 15% RH by using the "CYNTHIA 59" (manufactured by GEN-TECH, INC.). The fluctuation of surface potential was measured by repeating charging and exposure under the conditions of a grid voltage of −800 V and an exposure amount of 0.5 $\mu J/cm^2$ while rotating the photoreceptor at 130 rpm.

A: Residual potential is 20 V or less before and after printing durability (pass)

B: Residual potential is 20 V or less before printing durability but residual potential is greater than 20 V and 45 V or less after printing durability (pass)

C: Residual potential is greater than 20 V and 40 V or less before printing durability or residual potential is 20 V or less before printing durability and residual potential is greater than 45 V after printing durability (failure)

D: Residual potential is greater than 40 V before printing durability (failure)

(Image Memory)

The photoreceptors 1 to 22 were mounted on the evaluation machine, respectively, and first, the internal mounting pattern No. 53/Dot 1 (a representative exposure pattern formed in a dot shape exhibiting regularity) was continuously printed on the transfer material "POD gross coat" (A3 size, 100 g/m$^2$) (manufactured by OJI PAPER CO., LTD.) by 1000 sheets at a density indicating value of 255 and a black position in a low temperature and low humidity environment having a temperature of 10° C. and a relative humidity of 20% RH.

Thereafter, a monochrome image in which a solid black portion and a solid white portion were mixed was continuously printed by 10 sheets, a uniform halftone image was subsequently printed, and the generation of history, namely, memory of the monochrome image on this halftone image was visually observed and evaluated according to the following evaluation criteria (evaluation at initial stage).

Subsequently, a printing durability test that an image under the same condition was continuously printed by 500,000 sheets was conducted, a monochrome image in which a solid black portion and a solid white portion were mixed was then continuously printed by 10 sheets, a uniform halftone image was subsequently printed, and the generation of history, namely, memory of the monochrome image on this halftone image was visually observed and evaluated according to the following evaluation criteria (evaluation after being aged).

5: Image memory is not generated (favorable)

4: Minor image memory is slightly generated (no problem in practical use)

3: Minor image memory is visually observed (no problem in practical use)

2: Clear image memory is slightly generated (problem in practical use)

1: Clear image memory is generated (problem in practical use)

Dot Reproducibility

Double-sided printing of the internal mounting pattern No. 53/Dot 1 (a representative exposure pattern formed in a dot shape exhibiting regularity) on the A3/POD gross coat paper (100 g/m$^2$, manufactured by OJI PAPER CO., LTD.) was continuously conducted by 1,000 sheets at a density indicating value of 100 in an environment of 30° C. and 80% RH, and the state of dot formation was then observed by using a 100-fold magnifying glass. Next, double-sided printing of the same pattern was continuously conducted by 500,000 sheets as the durability test, and the state of dot formation was then evaluated in the same manner as the above. Incidentally, the evaluation criteria of dot reproducibility are as follows.

5: Dot is normally formed (favorable)

4: Dot is a bit thinned (no problem in practical use)

3: Dot is thinned (no problem in practical use)

2: Dot is hardly formed (problem in practical use)

1: Dot is not formed (problem in practical use)

(Fog)

The photoreceptors 1 to 22 were mounted on the evaluation machine, respectively, and first, the internal mounting pattern No. 53/Dot 1 (a representative exposure pattern formed in a dot shape exhibiting regularity) was continuously printed on the transfer material "POD gross coat" (A3 size, 100 g/m$^2$) (manufactured by OJI PAPER CO., LTD.) by 1000 sheets at a density indicating value of 255 and a black position in a low temperature and low humidity environment having a temperature of 10° C. and a relative humidity of 20% RH.

Thereafter, a transfer material "POD gross coat" (A3 size, 100 g/m$^2$) (manufactured by OJI PAPER CO., LTD.) on which an image was not formed was conveyed to a black position, a plain image (white solid image) was formed on the transfer material under the conditions of a grid voltage of −800 V and a developing bias of −650 V, and the presence or absence of fog on the transfer material thus obtained was visually observed. In the same manner, a yellow solid image was formed under the conditions of a grid voltage of −800 V and a developing bias of −650 V, and the presence or absence of fog on the transfer material thus obtained was visually observed. Thereafter, it was evaluated according to the following evaluation criteria (evaluation at initial stage).

Subsequently, a printing durability test that an image under the same condition was continuously printed by 500,000 sheets was conducted, thereafter a transfer material "POD gross coat" (A3 size, 100 g/m$^2$) (manufactured by OJI PAPER CO., LTD.) on which an image was not formed was conveyed to a black position, a plain image (white solid image) was formed on the transfer material under the conditions of a grid voltage of −800 V and a developing bias of −650 V, and the presence or absence of fog on the transfer material thus obtained was visually observed. In the same manner, a yellow solid image was formed under the conditions of a grid voltage of −800 V and a developing bias of −650 V, and the presence or absence of fog on the transfer material thus obtained was visually observed. Thereafter, it was evaluated according to the following evaluation criteria (evaluation after being aged).

5: Fog is not observed on both of white solid image and yellow solid image (pass)

4: Fog is slightly observed on either of white solid image or yellow solid image when being enlarged (no problem in practical use)

3: Fog is observed on both of white solid image and yellow solid image when being enlarged (no problem in practical use)

2: Fog is slightly visually observed on either of white solid image or yellow solid image (problem in practical use)

1: Fog is conspicuously observed on either of white solid image or yellow solid image (problem in practical use)

The configurations and evaluation results of the photoreceptors of Examples and Comparative Examples are presented in the following Table 1.

TABLE 1

| | | Metal oxide | | | | Dot reproduction | | Image memory | | Fog | |
|---|---|---|---|---|---|---|---|---|---|---|---|
| | n-type organic semiconductor | Metal oxide | Surface treatment agent | Hardness ($N/mm^2$) | ΔVi (V) | Initial (1000 sheets) | After being aged (500,000 sheets) | Initial (1000 sheets) | After being aged (500,000 sheets) | Initial (1000 sheets) | After being aged (500,000 sheets) |
| Example 1 | ETM01 | $CuAlO_2$ | KBM-503 | 258 | A | 5 | 4 | 5 | 4 | 5 | 4 |
| Example 2 | ETM02 | $CuAlO_2$ | KBM-503 | 235 | A | 4 | 3 | 4 | 3 | 4 | 3 |
| Example 3 | ETM03 | $CuAlO_2$ | KBM-503 | 265 | B | 4 | 3 | 4 | 3 | 4 | 3 |
| Example 4 | ETM04 | $CuAlO_2$ | KBM-503 | 251 | A | 4 | 4 | 4 | 4 | 4 | 4 |
| Example 5 | ETM01 | $SrCu_2O_2$ | KBM-503 | 254 | A | 4 | 3 | 4 | 3 | 4 | 4 |
| Example 6 | ETM05 | $SrCu_2O_2$ | KBM-503 | 251 | B | 4 | 4 | 4 | 4 | 4 | 4 |
| Example 7 | ETM02 | $CuInO_2$ | KBM-503 | 235 | A | 4 | 4 | 4 | 4 | 4 | 4 |
| Example 8 | ETM02 | $BaCu_2O_2$ | KBM-503 | 232 | B | 5 | 3 | 5 | 3 | 5 | 3 |
| Example 9 | ETM02 | CuNbO | KBM-503 | 243 | B | 4 | 3 | 3 | 3 | 3 | 3 |
| Example 10 | ETM01 | CuTaO | KBM-503 | 228 | B | 3 | 3 | 4 | 3 | 3 | 3 |
| Example 11 | ETM06 | $CuAlO_2$ | KBM-503 | 250 | B | 4 | 3 | 4 | 3 | 5 | 3 |
| Example 12 | ETM201 | $CuAlO_2$ | KBM-503 | 225 | A | 4 | 3 | 4 | 3 | 4 | 3 |
| Example 13 | ETM311 | $CuAlO_2$ | KBM-503 | 266 | B | 4 | 3 | 3 | 3 | 4 | 3 |
| Example 14 | ETM401 | $CuAlO_2$ | KBM-503 | 264 | B | 3 | 3 | 4 | 4 | 4 | 4 |
| Example 15 | ETM501 | $CuAlO_2$ | KBM-503 | 233 | B | 4 | 3 | 4 | 4 | 4 | 3 |
| Example 16 | ETM02 | $CuAlO_2$ | KBM-5103 | 249 | A | 4 | 3 | 4 | 3 | 4 | 3 |
| Example 17 | ETM01<br>ETM02 | $CuAlO_2$ | KBM-503 | 221 | B | 4 | 3 | 3 | 3 | 5 | 4 |
| Example 18 | ETM02 | $CuAlO_2$<br>$SrCu_2O_2$ | KBM-503 | 272 | B | 4 | 4 | 5 | 4 | 4 | 3 |
| Example 19 | ETM01 | $CuAlO_2$<br>$SnO_2$ | KBM-503 | 269 | B | 4 | 3 | 4 | 3 | 4 | 3 |
| Comparative Example 1 | Nil | $CuAlO_2$ | KBM-503 | 235 | C | 3 | 1 | 3 | 2 | 2 | 1 |
| Comparative Example 2 | ETM01 | | Nil | 196 | C | 2 | 1 | 1 | 1 | 3 | 2 |
| Comparative Example 3 | Nil | $CuAlO_2$<br>$SnO_2$ | KBM-503 | 255 | B | 2 | 1 | 3 | 1 | 2 | 1 |

Although the present invention has been described and illustrated in detail, it is clearly understood that the same is by way of illustrated and example only and is not to be taken by way of limitation, the scope of the present invention being interpreted by terms of the appended claims.

What is claimed is:

1. An electrophotographic photoreceptor comprising at least a photosensitive layer and a protective layer sequentially layered on a conductive support, wherein the protective layer contains a cured product of a curable composition containing p-type semiconductor fine particles, an n-type organic semiconductor, and a polymerizable compound, the p-type semiconductor fine particles are formed from at least one compound selected from the group consisting of compounds represented by chemical formulas (6) to (8):

$$M^1Cu_2O_2 \quad (6)$$

$$CuM^2O_2 \quad (7)$$

$$CuM^3O \quad (8)$$

wherein $M^1$ represents an element in group 2, $M^2$ represents an element in group 13, and $M^3$ represents an element in group 5, and the n-type organic semiconductor contains at least one compound selected from the group consisting of ETM01, ETM02, ETM03, ETM04, ETM05, ETM06, ETM201, ETM202, ETM203, ETM301, ETM302, ETM303, 2,5-di-tert-butyl-p-quinone, 2,6-di-tert-butyl-p-quinone, 2,3,5,6-tetra-tert-butyl-p-quinone, naphthoquinone, anthraquinone, 3,3',5,5'-tetra-tert-butyl-4,4'-diphenoquinone, 3,3',5,5'-tetramethyl-4,4'-diphenoquinone, 3,3',5,5'-tetraethyl-4,4'-diphenoquinone, 3,3',5,5'-tetra-n-butyl-4,4'-diphenoquinone, 3,3'-di-tert-butyl-5,5'-dimethyl-4,4'-diphenoquinone, bianthrone, ETM314, ETM401, and ETM501, wherein the ETM01, ETM02, ETM03, ETM04, ETM05, ETM06, ETM201, ETM202, ETM203, ETM301, ETM302, ETM303, ETM314, ETM401, and ETM501 are as follows:

ETM01

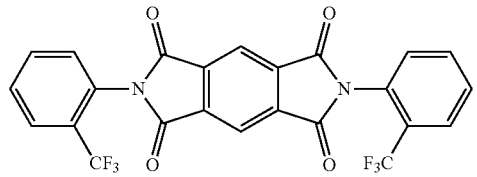

ETM02

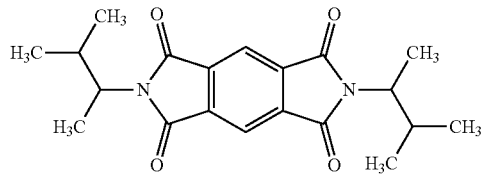

ETM03

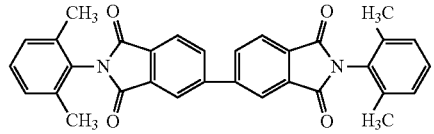

-continued

ETM04

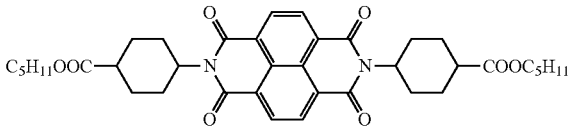

ETM05

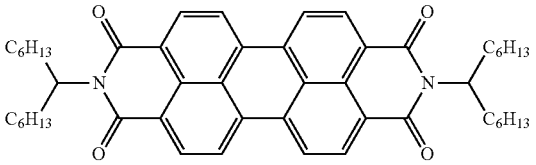

ETM06

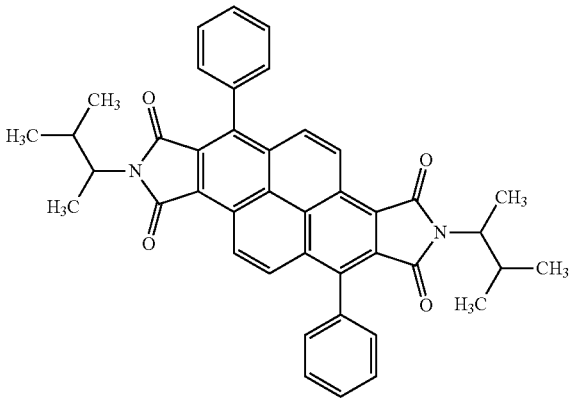

ETM201

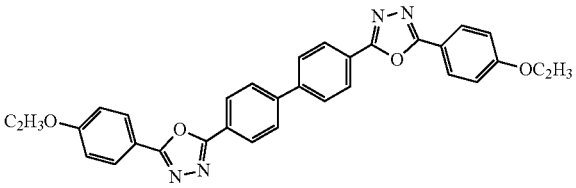

ETM202

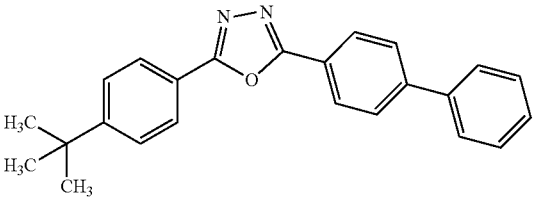

ETM203

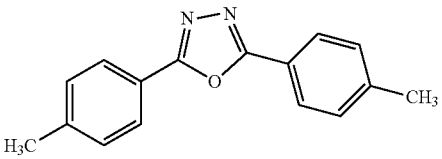

ETM301

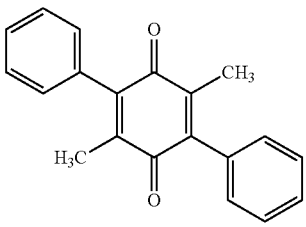

-continued

ETM302

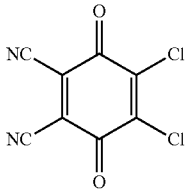

ETM303

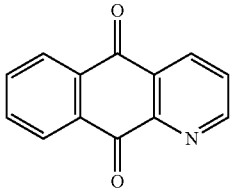

ETM314

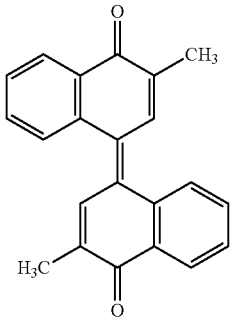

ETM401

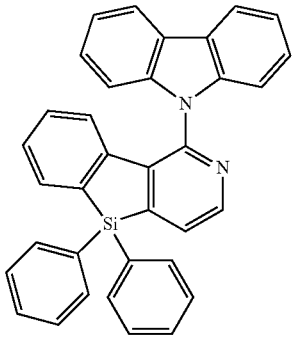

ETM501

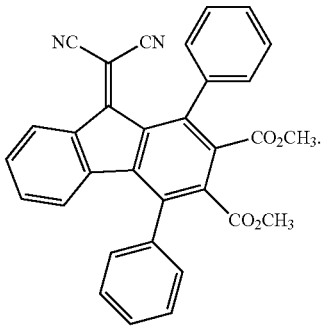

2. The electrophotographic photoreceptor according to claim 1, wherein the p-type semiconductor fine particles have a reactive organic group on a surface thereof.

3. The electrophotographic photoreceptor according to claim 1, wherein the polymerizable compound has a (meth) acryloyl group.

4. An image forming apparatus comprising the electrophotographic photoreceptor according to claim 1.

5. The electrophotographic photoreceptor according to claim 1, wherein a proportion of the p-type semiconductor fine particles to the n-type organic semiconductor contained in the curable composition is from 10:1 to 20:1.

* * * * *